US010407860B2

(12) United States Patent
Jinnings et al.

(10) Patent No.: US 10,407,860 B2
(45) Date of Patent: Sep. 10, 2019

(54) RECIPROCATING HAMMER WITH DOWNWARD THRUST ASSIST

(71) Applicant: HERCULES MACHINERY CORPORATION, Fort Wayne, IN (US)

(72) Inventors: John Jinnings, Leo, IN (US); Brian Widenhoefer, Huntertown, IN (US); James J. Connerley, Noblesville, IN (US)

(73) Assignee: Hercules Machinery Corporation, Fort Wayne, IN (US)

( * ) Notice: Subject to any disclaimer, the term of this patent is extended or adjusted under 35 U.S.C. 154(b) by 434 days.

(21) Appl. No.: 15/113,785

(22) PCT Filed: Jan. 22, 2015

(86) PCT No.: PCT/US2015/012468

§ 371 (c)(1),
(2) Date: Jul. 22, 2016

(87) PCT Pub. No.: WO2015/112722

PCT Pub. Date: Jul. 30, 2015

(65) Prior Publication Data

US 2016/0333542 A1 Nov. 17, 2016

Related U.S. Application Data

(60) Provisional application No. 61/930,767, filed on Jan. 23, 2014, provisional application No. 62/073,297, filed on Oct. 31, 2014.

(51) Int. Cl.
*E02D 7/10* (2006.01)
*B25D 9/06* (2006.01)

(52) U.S. Cl.
CPC ..... *E02D 7/10* (2013.01); *B25D 9/06* (2013.01)

(58) Field of Classification Search
CPC ..... B25D 9/06; E02D 7/10
(Continued)

(56) References Cited

U.S. PATENT DOCUMENTS 808,377 A 12/1905 Johnson et al.
1,494,501 A 5/1924 Prescott
(Continued)

FOREIGN PATENT DOCUMENTS

DE 4440575 5/1996
JP 5847826 3/1983
(Continued)

OTHER PUBLICATIONS

International Search Report and Written Opinion dated Jun. 17, 2015 in International Application No. PCT/US2015/012468.

*Primary Examiner* — Andrew M Tecco
*Assistant Examiner* — Praachi M Pathak
(74) *Attorney, Agent, or Firm* — Faegre Baker Daniels LLP

(57) ABSTRACT

A reciprocating hammer with a two-stage acceleration of a pile driving ram, including a first stage in which initial gravitational acceleration is assisted by a thruster and a second stage in which the initially accelerated ram is allowed to further accelerate under the force of gravity alone for the remainder of the pile driver stroke. The force assist in the initial acceleration stage acts as a force multiplier, such that the anvil delivers impact forces to the pile greater than the impact forces achievable by gravity alone for a given stroke length/ram weight combination.

25 Claims, 25 Drawing Sheets

(58) Field of Classification Search
USPC ..... 173/112
See application file for complete search history.

(56) References Cited

U.S. PATENT DOCUMENTS

| | | | | |
|---|---|---|---|---|
| 2,055,001 | A | 9/1936 | Blomquist | |
| 2,594,522 | A | 4/1952 | Thompson | |
| 2,599,995 | A | 6/1952 | Hobson et al. | |
| 3,205,952 | A | 9/1965 | Sicotte | |
| 4,408,668 | A | 10/1983 | Kühn et al. | |
| 4,484,638 | A | 11/1984 | West | |
| 5,662,175 | A * | 9/1997 | Warrington | E02D 7/10 173/115 |
| 6,000,477 | A | 12/1999 | Campling et al. | |
| 6,003,619 | A | 12/1999 | Lange | |
| 7,237,706 | B2 | 7/2007 | Vought | |
| 7,331,405 | B2 | 2/2008 | Robson | |
| 8,316,960 | B2 | 11/2012 | Robson | |
| 2010/0012336 | A1 | 1/2010 | Adamson | |

FOREIGN PATENT DOCUMENTS

| | | |
|---|---|---|
| JP | 2004132149 | 4/2004 |
| WO | 2013/054262 | 4/2013 |

* cited by examiner

RECIPROCATING HAMMER WITH DOWNWARD THRUST ASSIST

CROSS-REFERENCE TO RELATED APPLICATIONS

The present application is a national stage filing of International Patent Application No. PCT/US2015/012468, which claims the benefit under Title 35, U.S.C. § 119(e) of U.S. Provisional Patent Application Ser. No. 61/930,767 filed Jan. 23, 2014 and U.S. Provisional Patent Application Ser. No. 62/073,297 filed Oct. 31, 2014, both of which are entitled "RECIPROCATING HAMMER WITH DOWNWARD THRUST ASSIST," the entire disclosures of which are hereby expressly incorporated by reference herein.

BACKGROUND

1. Technical Field

The present disclosure relates to reciprocating hammers and, more specifically, to a reciprocating hammer with downward thrust assist.

2. Description of the Related Art

Pile driver mechanisms are used to drive piles (i.e., poles) into soil or other earthen material, such as to provide foundation support for buildings or other structures. Traditional pile drivers have a ram constrained by a guide structure so that the ram is able to freely slide up and down along a vertical axis. In use, the ram is aligned with a pile to be driven, raised (i.e., by hydraulics or other energy source), then released so that the ram drops through a distance determined by the guide structure and impacts the pile, delivering its kinetic energy to drive the pile into the ground.

In this raise/release modality for pile driving, there are two determinates of impact strength: the weight of the ram and the length of its stroke from the release point to the impact point. For example, a 10,000 pound weight dropped a distance of three feet upon a pile below theoretically yields up to 30,000 foot-pounds of impact force, it being understood that the actual impact force will be marginally lower to account for air resistance, friction, and other mechanical inefficiencies. In order to increase this 30,000 foot-pound theoretical maximum, the weight of the pile driver ram and/or the stroke length of the guide structure must be increased.

Pile driving mechanisms may be positioned and actuated by industrial machinery with the weight carrying capacity and vertical reach sufficient for a particular application. For example, excavator machines having articulating arms may have a pile driving mechanism attached at the distal end of such an articulating arm, which raises the mechanism to a desired height and positions the mechanism over a pile to be driven. In other instances, mobile or stationary cranes may be used in a similar fashion, with pile driving mechanisms attached to or suspended from the end of the telescoping arm of the crane. However, the weight capacity of the machine to which the pile driving assembly is mounted limits the maximum weight of the pile driving ram, while the height capacity of the machine's pile driving mechanism mount limits the overall height of the mechanism and therefore the possible stroke through which the ram may be dropped.

SUMMARY

The present disclosure provides a reciprocating hammer with a two-stage acceleration of a pile driving ram, including a first stage in which initial gravitational acceleration is assisted by a thruster and a second stage in which the initially accelerated ram is allowed to further accelerate under the force of gravity alone for the remainder of the pile driver stroke. The force assist in the initial acceleration stage acts as a force multiplier, such that the anvil delivers impact forces to the pile greater than the impact forces achievable by gravity alone for a given stroke length/ram weight combination.

The thruster used for the first stage acceleration may be a hermetically sealed, pressurized-chamber actuator which maintains its hermetically sealed configuration during operation without any external fluid supply, valving or timing mechanisms. For purposes of the present disclosure, "hermetically" sealed is a sealed configuration in which no substantial amount of fluid is allowed to enter or escape the sealed volume, except for any unintended leakage which may occur with any sealed chamber.

As the ram approaches the top of its stroke, it impacts the piston rod of the thruster to compress and further pressurize the gas contained within the thruster chamber, thereby storing energy to be released upon the ram during the initial acceleration. In an alternative embodiment, a spring or set of springs may be used for the thruster rather than the hermetically sealed, pressurized-chamber actuator. A drive mechanism is used to lift the ram though its gravity-only stroke, and through its assisted stroke in which the thruster is compressed.

A jump arrestor system may also be provided in certain exemplary embodiments. In particular, the lightweight reciprocating hammer may be slidably mounted to, e.g., a boom of an excavator or other vehicle, such that the hammer can "follow" a pile downwardly throughout successive hammer blows without repositioning the boom. In some cases, this slidable attachment may allow the frame of the hammer to "jump" upwardly as a result of the sudden and forceful discharge of the thruster during the assisted downward stroke of the ram. One or more springs may be disposed between the hammer frame and its mounting point and arranged to bias the frame downwardly, thereby partially or completely preventing the "jump" of the frame while preserving the slidable-mounting functionality of the lightweight hammer assembly.

In one form thereof, the present disclosure provides a reciprocating hammer comprising a ram cyclically movable from a raised position to an impact position along a two-stage stroke length, the two-stage stroke length comprising an assisted stroke length and a freefall stroke length, the assisted stroke length extending from the raised position to an intermediate position and the freefall stroke length extending from the intermediate position to the impact position; a drive mechanism selectively functionally coupled to the ram and operable to lift the ram from the impact position through the two-stage stroke length and to the raised position, and then to functionally decouple from the ram to allow the ram to fall from the raised position to the impact position; and a thruster compressible by the ram as the ram advances from the intermediate position to the raised position, the thruster receiving stored energy from the drive mechanism as the thruster compresses, the thruster discharging the stored energy to the ram as the ram falls through the assisted stroke length, whereby the thruster releases the stored energy to the ram in cooperation with gravity to initially accelerate the ram through the assisted stroke length, and the ram further accelerates through the freefall stroke length under the force of gravity alone.

In another form thereof, the present disclosure provides a method of lifting a ram through a stroke length including an impact position, an intermediate position above the impact position and a raised position above the intermediate position, the method comprising lifting the ram from the impact position to the intermediate position by providing a first lifting force; lifting the ram from the intermediate position to the raised position by providing a second lifting force greater than the first lifting force; and compressing an accumulator only during the step of lifting the ram from the intermediate position to the raised position, the step of compressing storing energy in the accumulator.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Figure 1:
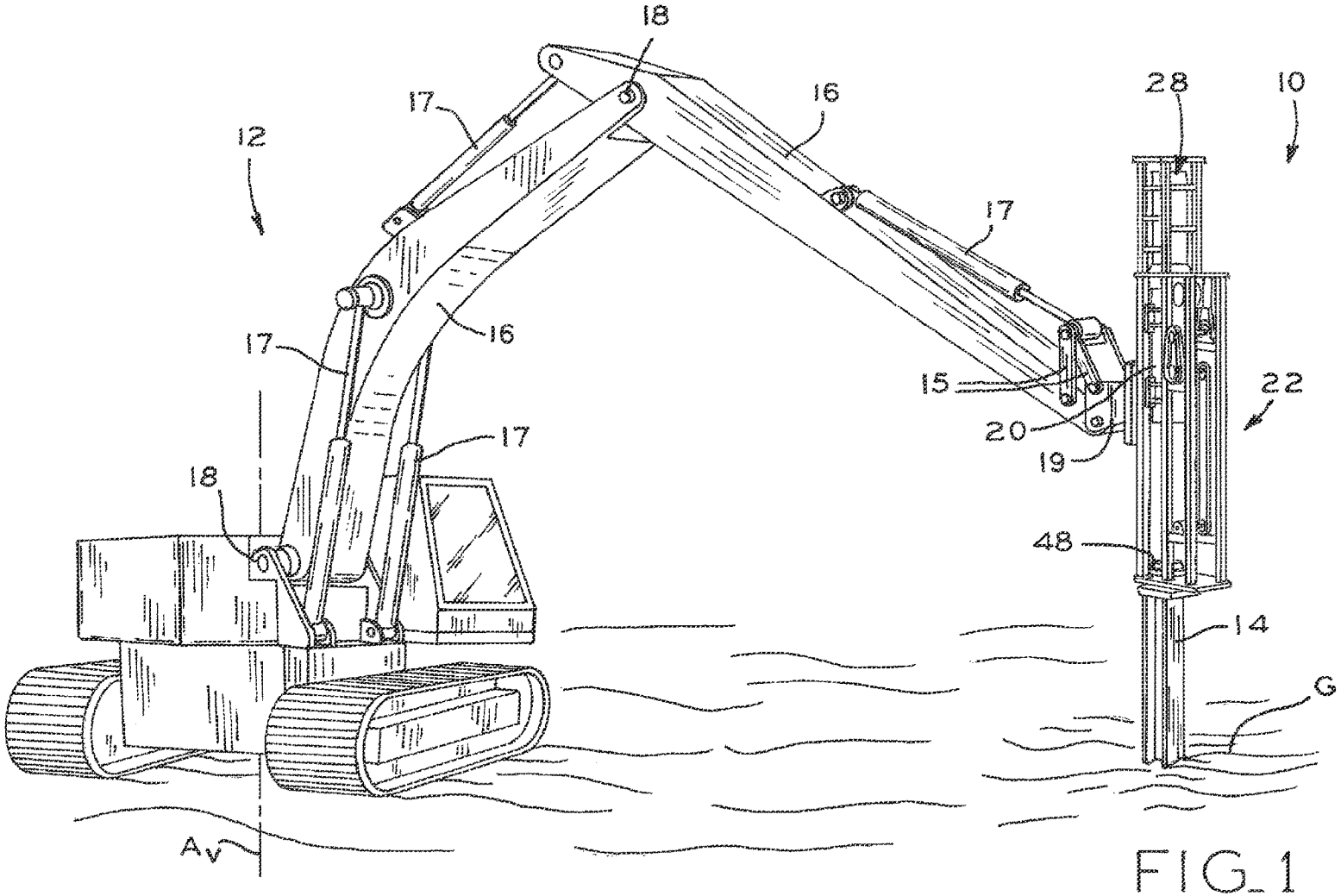
FIG. 1 is a perspective view of a reciprocating hammer in accordance with the present disclosure, mounted to an excavator boom and engaged with a pile.

Referring to FIG. 1, reciprocating hammer 10 in accordance with the present disclosure is shown mounted to boom 16 of excavator 12. Hammer 10 is placed by excavator 12 into position over pile 14 in a force transferring relationship (as described in further detail below) by manipulation of boom 16 by actuation of hydraulic cylinders 17. Specifically, as the operator of excavator 12 extends or retracts hydraulic cylinders 17, respective arms of boom 16 pivot around joints 18 to raise, lower or reposition the distal end of boom 16 to which reciprocating hammer 10 is affixed. In addition, the entirety of boom 16 may be pivoted around vehicle axis $A_V$ for further flexibility in repositioning reciprocating hammer 10.

In the illustrated embodiment, the distal end of boom 16 includes mounting bracket 19, which is manipulable by the distal hydraulic cylinder 17 via a pair of linkage arms 15 as illustrated. As described in further detail below, mounting bracket 19 slidingly interfaces with reciprocating hammer 10 such that hammer 10 is allowed to vertically lower itself as pile 14 is driven deeper with each blow of ram 20.

For purposes of the present disclosure, reciprocating hammer 10 is described in the context of excavator 12. However, it is appreciated that other vehicles or mechanisms, such as stationary or mobile cranes, may be used to provide power, positioning and height adjustment of hammer 10 as required or desired for a particular application.

In order to drive pile 14 into ground G using reciprocating hammer 10, anvil 48 is positioned in force transferring relationship with the end of pile 14 as illustrated in FIG. 1. Ram 20 is brought to a raised position using motor 24 (FIG. 2) via drive mechanism 22 as described in further detail below. As ram 20 reaches the top of its stroke, energy accumulates in accumulator 28 as further described below. When ram 20 is released and allowed to begin its downward stroke towards impact with pile 14 via anvil 48, accumulator 28 becomes a thruster, releasing the accumulated energy to initially accelerate ram 20 in cooperation with the force of gravity.

After thruster 28 completes its stroke and has transferred its stored energy into kinetic energy of ram 20, ram 20 continues to fall through the remainder of its stroke while accelerating under the force of gravity alone. At the bottom of its stroke, ram 20 reaches its bottom position at which it impacts anvil 48, thereby transferring its kinetic energy to pile 14 to drive pile 14 incrementally further into ground G.

Reciprocating hammer 10 is then repositioned downwardly to bring anvil 48 back into abutment with the (now lowered) end of pile 14, and the process begins again. An exemplary system and method for repositioning reciprocating hammer 10 and overall manipulation thereof is described in U.S. Pat. No. 7,387,173, filed Mar. 7, 2006 and entitled Pile Driver, the entire disclosure of which is hereby incorporated by reference herein for all that it teaches and for all purposes.

Figure 2:
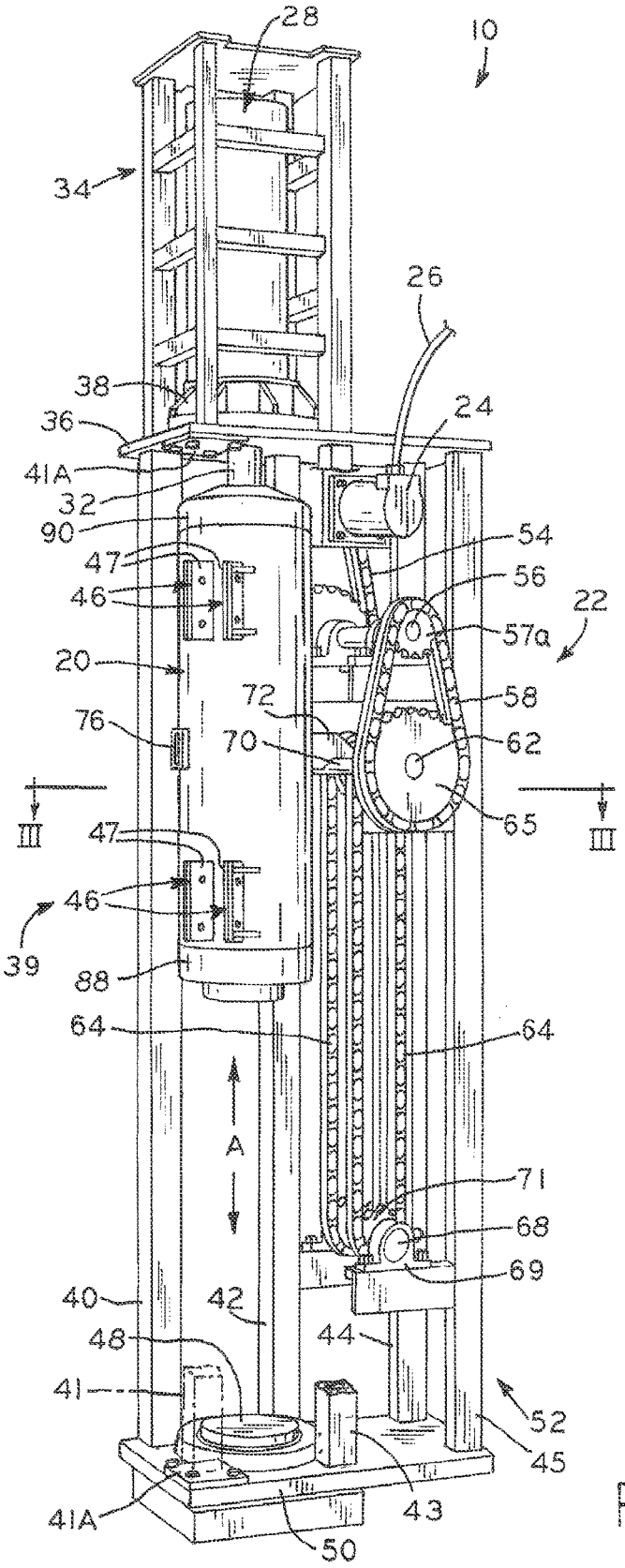
FIG. 2 is a perspective view of the reciprocating hammer shown in FIG. 1.

Turning to FIG. 2, a detailed perspective view of reciprocating hammer 10 illustrating the systems thereof is shown. To provide structural support for these systems, reciprocating hammer 10 includes ram frame 39, accumulator frame 34 and drive assembly frame 52 which are respectively sized and designed to accommodate ram 20, accumulator/thruster 28, and drive assembly 22. Ram frame 39 includes bottom plate 50, top plate 36, and vertical frame members 40, 41, 42 and 43 extending therebetween. In FIG. 2, portions of vertical frame members 41 and 43 are shown removed for clarity. As illustrated, ram 20 is vertically movable within the space between vertical frame members 40, 41, 42 and 43 (FIG. 3) along an axial path A.

Accumulator frame 34 is mounted above top plate 36 of ram frame 39, and serves to protect and contain accumulator 28. Connecting collar 38, which may include stiffening ribs as illustrated, provides for attachment and interface between top plate 36 and accumulator 28, with sufficient rigidity and strength to keep accumulator 28 rigidly fixed to ram frame 39 during energy accumulation and discharge as described below.

Figure 3:
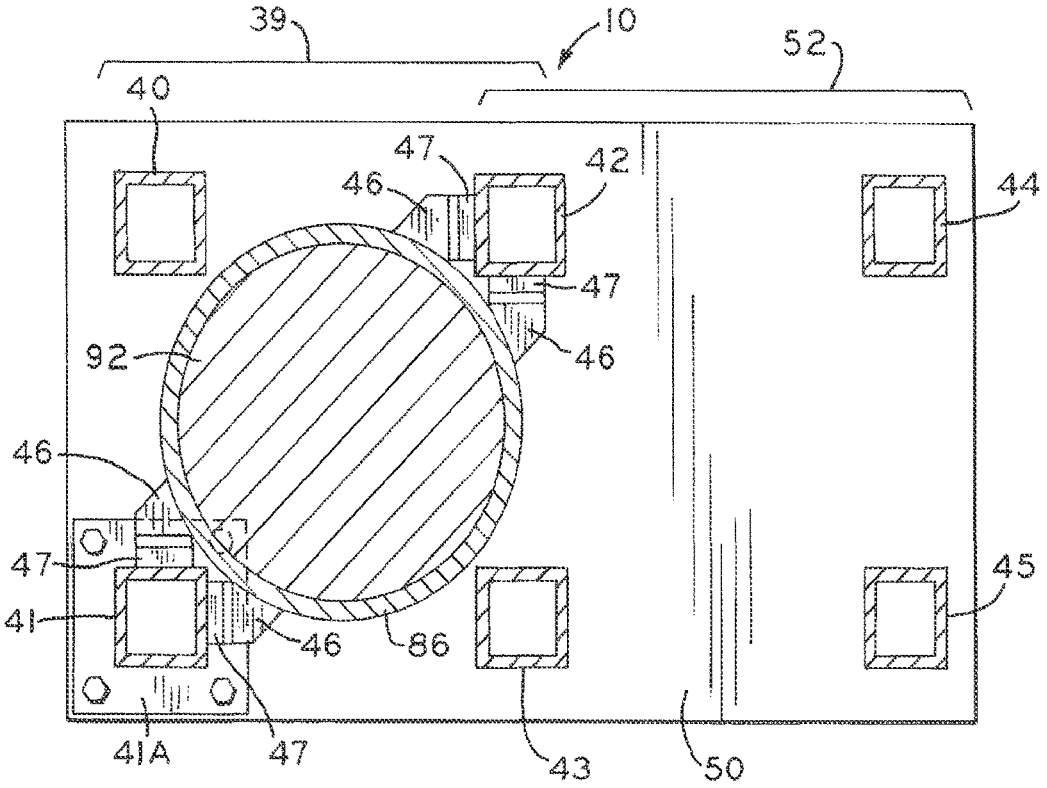
FIG. 3 is a plan, cross-sectional view of the reciprocating hammer of FIG. 2, taken along the line III-III.

In an exemplary embodiment, guides 46 are affixed to the outside surface of ram 20 and positioned to constrain ram 20 to axial path A by interacting with frame members 41 and 42. Specifically, guides 46 may include pads 47, used as a bearing material to slide along adjacent outer surfaces of frame members 41 and 42, as best seen in FIG. 3. In an exemplary embodiment, pads 47 are made from a low friction polymer material, such as Teflon® or ultra-high molecular weight (UHMW) plastic material, such as UHMW polyethylene (UHMWPE). In the illustrated embodiment of FIG. 3, mutually opposed vertical frame members 41 and 42 are chosen for engagement with guides 46, which fully constrains the movement of ram 20 to axial travel along direction A, while avoiding redundancy in such constraint and precluding potential misalignment or binding of any additional pads on vertical frame members 40 and 43. However, it is contemplated that additional guides 46 and pads 47 may be used in some applications.

Vertical frame member 41, shown in FIGS. 2 and 3, is removably attached to bottom and top plates 50, 36 via attachment plates 41A, which allows vertical frame member 41 to be removed to facilitate access to, removal of, and servicing of ram 20, guides 46 and pads 47. The remaining three vertical frame members 40, 42 and 43 are permanently secured (e.g., welded) to bottom plate 50 and/or top plate 36 for strength and rigidity of ram frame 39.

In the illustrated embodiment, ram 20 is formed from a cylindrical shell 86 capped at each axial end by caps 88 and 90 to form a sealed internal cavity, which may be filled with a filler material 92 (FIG. 3), such as lead. In one exemplary embodiment, filler material 92 may be constrained from moving up or down within the sealed internal cavity such that ram 20 is a solid contruct without moveable internal mass or parts. During downward acceleration at a rate exceeding gravitation acceleration, the fixed filler material 92 is prevented from "lofting" as ram 20 is accelerated. In this way, filler material 92 is prevented from absorbing energy during the acceleration of ram 20, which in turn ensures that all available energy is transferred to pile 14. For example, filler 92 may be a melted or otherwise monolithic mass of a lead fixed within the cavity of shell 86. Shell 86, caps 88 and 90, and filler 92 cooperate to provide a desired weight of ram 20. In one exemplary embodiment, for example, ram 20 may weigh 3,000 pounds, though it is appreciated that the dimensions of shell 86 and the material and amount of filler 92 may be varied to result in other weights as required or desired for a particular application.

1. Lift Mechanism

Figure 9:
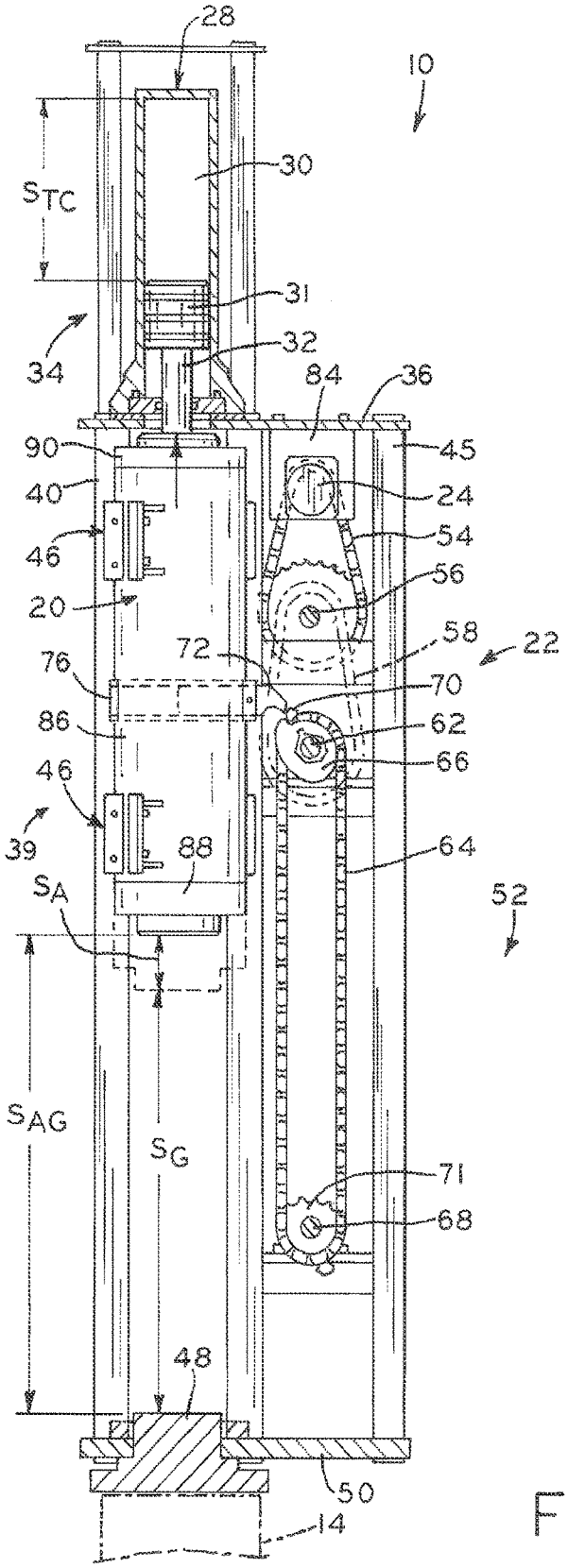
FIG. 9 is another elevation, cross-sectional view of the reciprocating hammer of FIG. 8, in which the pusher cam has lifted the ram to its upper position and fully compressed the charge of the thruster.
Figure 10:
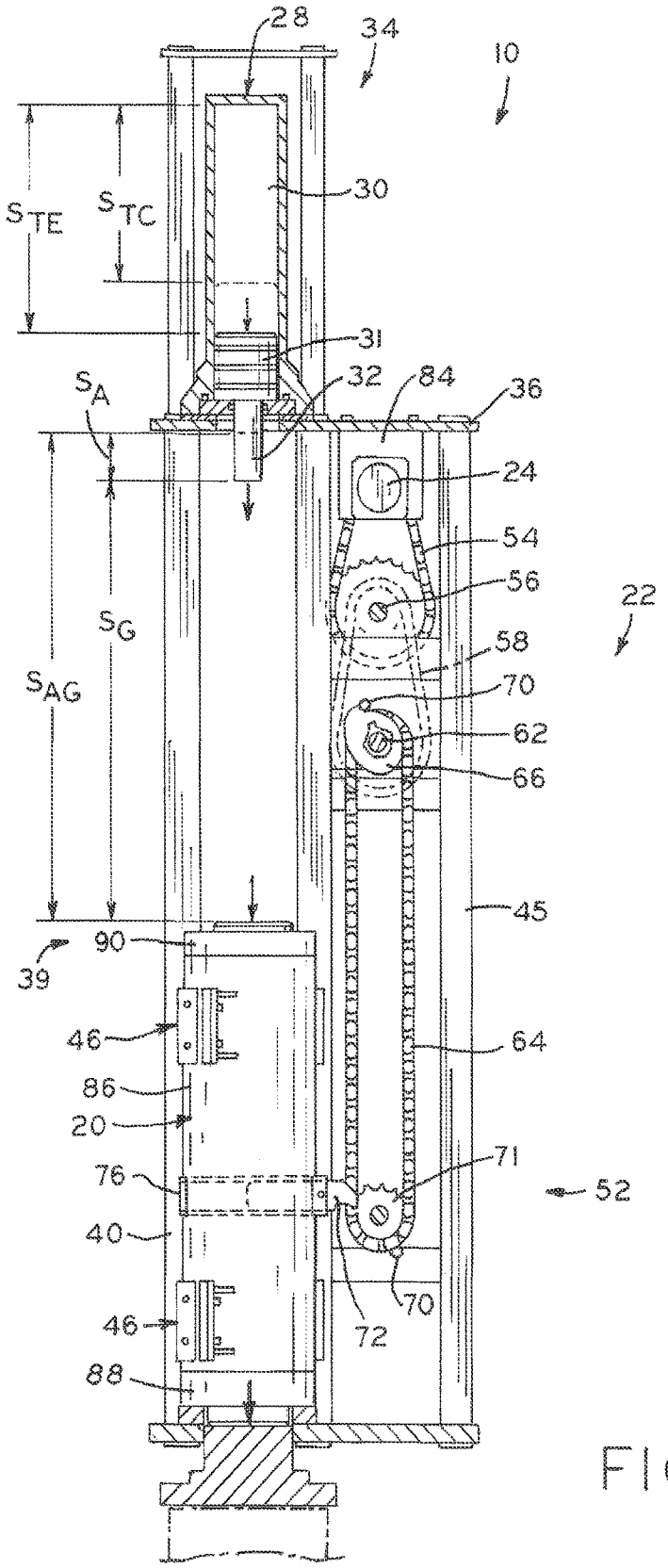
FIG. 10 is another elevation, partial cross-sectional view of the reciprocating hammer of FIG. 9, in which the pusher cam has disengaged from the lift bar and ram to allow the ram to advance downwardly under the force of the thruster and gravity.

Elevation of ram 20 to a raised, release position (see, e.g., FIG. 9) is effected by drive assembly 22. When ram 20 is at its fully lowered (i.e., impact) position, as shown in FIG. 10, lift hook 72 is positioned near the bottom of the path of lift chains 64, ready to be engaged by lift bar 70 to begin elevating ram 20. Lift hook 72 is the operative end of lifter 76, which extends across the lateral (i.e., radial) extent of shell 86 of ram 20 such that lift hook 72 is rigidly and securely affixed to ram 20. More particularly, lifter 76 is formed as a tube or bar which extends through mutually opposed apertures formed in shell 86, i.e., a crossbar. Lifter 76 is held in place by end caps to preclude lifter 76 from sliding out of these apertures, and one such endcap further fixes lift hook 72 to lifter 76 (as shown in FIGS. 5 and 6).

In an exemplary embodiment, lifter 76 and lift hook 72 are a single, solid monolithic part.

Figure 4:
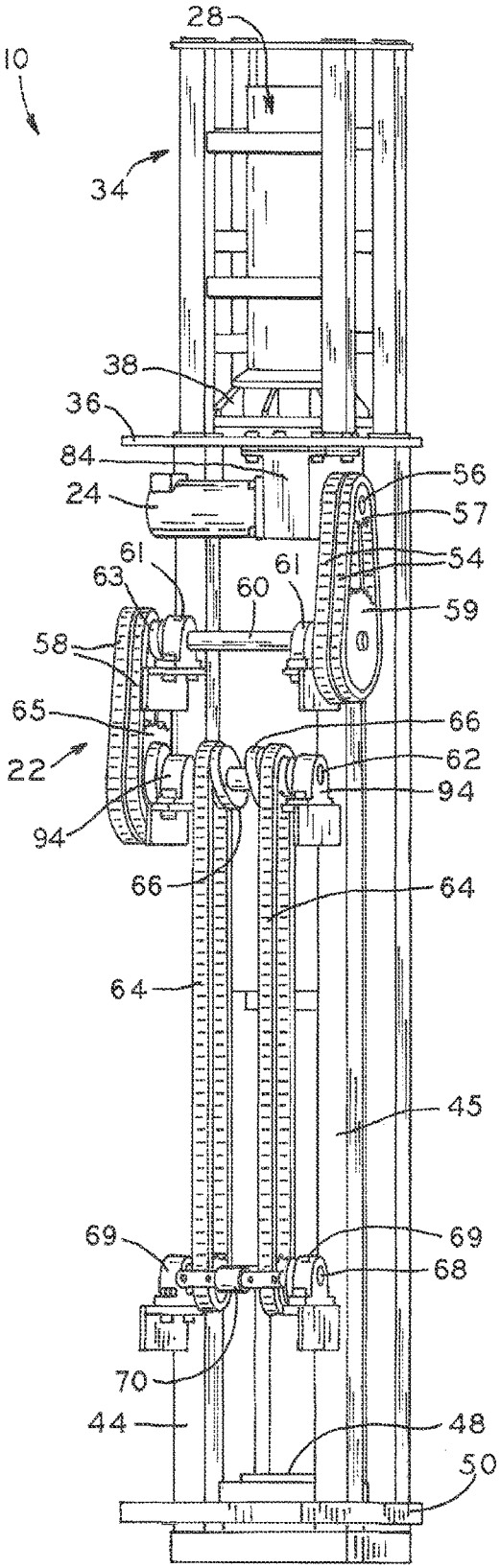
FIG. 4 is another perspective view of the reciprocating hammer of FIG. 2, with certain components removed for clarity.
Figure 5:
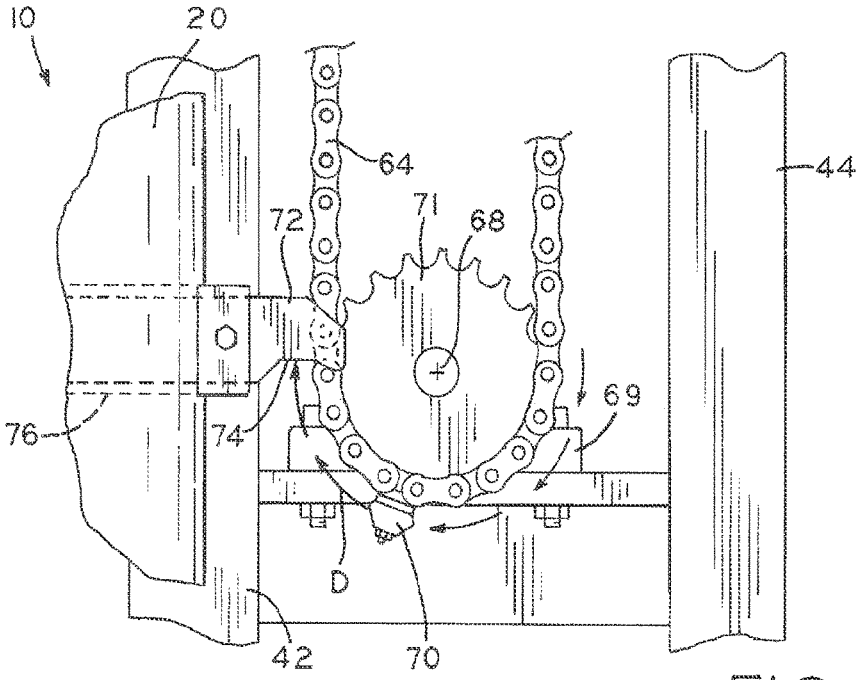
FIG. 5 is a partial elevation, cross-sectional views of the reciprocating hammer of FIG. 2, illustrating a pre-engagement configuration of the lift bar with a ram.
Figure 6:
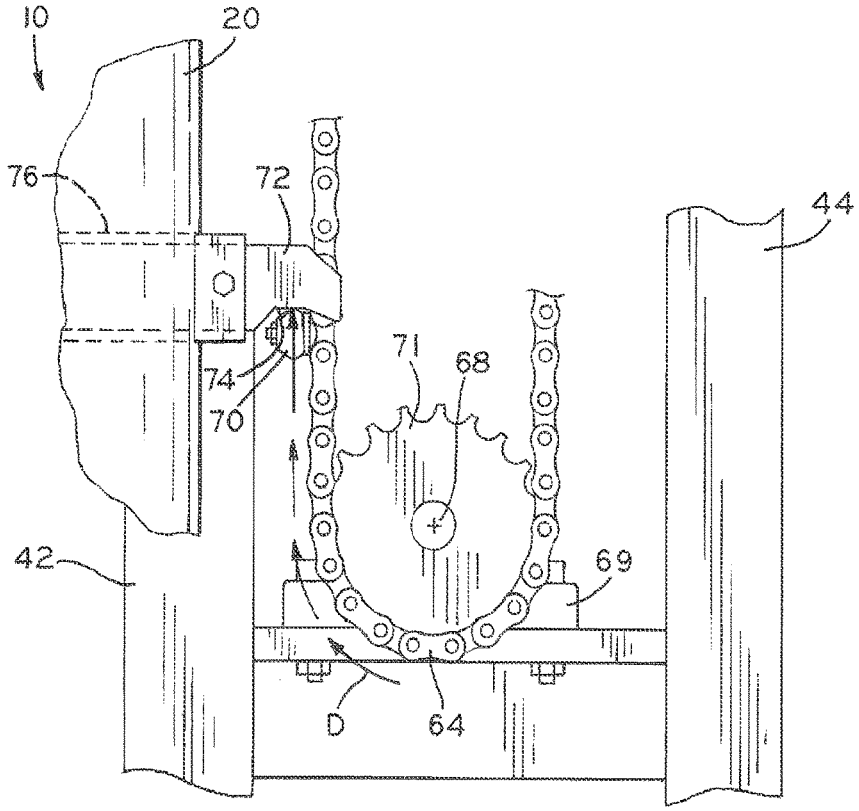
FIG. 6 is another partial elevation, cross-sectional view of the reciprocating hammer of FIG. 5, illustrating the lift bar engaged with and beginning to lift the ram.
Figure 15:
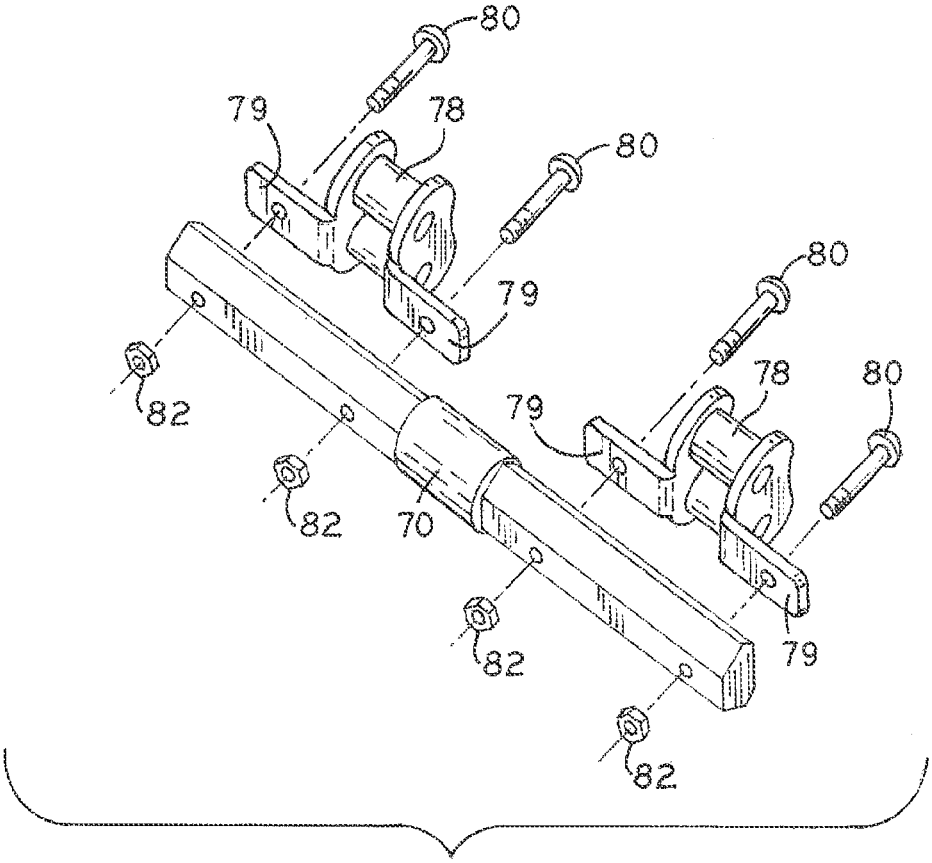
FIG. 15 is an exploded view of the lift bar assembly shown in FIG. 2, including the lift bar and associated chain attachment links.

Turning to FIG. 5, lift bar 70 is shown approaching lift hook 72 along chain advancement direction D of lift chains 64. Lift bar 70 is rigidly affixed to each of the pair of lift chains 64 (FIG. 4, in which chains are shown schematically without individual chain links for simplicity) and spans a lateral distance therebetween. As best seen in FIG. 15, each of lift chains 64 includes a special attachment link 78 with a pair of mounting flanges 79 sized and positioned to receive lift bar 70. Specifically, fasteners 80 pass through aligned apertures in mounting flanges 79 and lift bar 70, and nuts 82 are then attached to fasteners 80 to securely affix lift bar 70 to attachment links 78 to form a lift bar assembly. When nuts 82 are tightened, lift bar 70 is affixed to each of chains 64 such that advancement of chains 64 along direction D also advances lift bar 70 along direction D.

Figure 16:
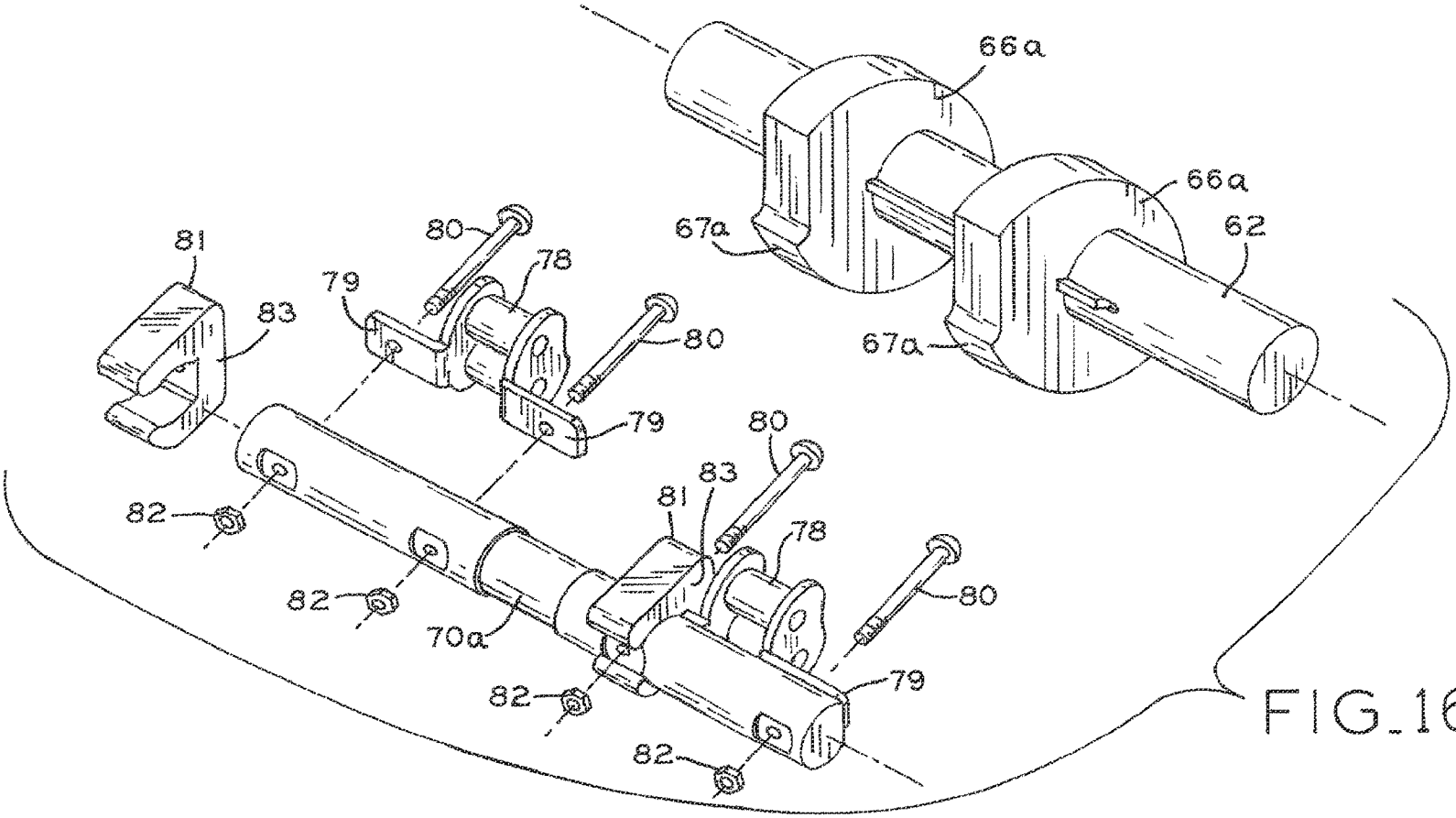
FIG. 16 is an exploded view of an alternative lift bar assembly useable with the reciprocating hammer of FIG. 2.

An alternative lift bar assembly including lift bar 70*a* is shown in FIG. 16. Except as described below, lift bar 70*a* is structurally and functionally similar to lift bar 70, with corresponding structures having corresponding reference numbers with an "a" added thereto. As illustrated, lift bar 70*a* has attachment links 78 mounted thereto via mounting flanges 79, in the same manner as described above. In addition, C-clamps 81 are also attached to lift bar 70*a* over the inner mounting flange 79 of each link 78. Upon assembly, each C-clamp 81 is slid over the outer surface of lift bar 70*a* until mounting holes through clamp body 83 align with the corresponding mounting hole through lift bar 70*a*, and a respective flange 79 is then slid into similar alignment between body 83 and the adjacent surface of lift bar 70*a* Inner bolts 80, which are longer than the outer bolts 80 to accommodate the extra material of clamp body 83, are then passed through the aligned apertures of clamp body 83, flange 79, and lift bar 70*a*. In an exemplary embodiment, a countersink is provided in clamp body 83 so that the head of bolt 80 does not interrupt the generally planar surface interface with cam 66*a* (described below). Nut 82 is threaded onto the exposed end of bolt 80 to secure each C-clamp 81 to lift bar 70*a*. As can be seen in FIG. 16, the arms of C-clamp 81 curve inwardly such that C-clamps 81 can only be removed from lift bar 70*a* by sliding C-clamps 81 over the outer surface thereof, in the reverse of the assembly procedure described above, which provides further security of attachment between C-clamp 81 and lift bar 70*a*. As further described below, C-clamps 81 provide an interface with cams 66*a* to lift ram 20 through assisted stroke length $S_A$ (FIG. 10).

Turning to FIG. 6, further advancement of chains 64 along direction D seats lift bar 70 within notch 74 of lift hook 72, such that chains 64 begin to lift ram 20 up from the impact position via lift bar 70. In order to constrain the lower portion of chains 64 to maintain chains 64 taut during this lift procedure, lower sprockets 71 supported by lower shaft 68 and roller bearings 69 are affixed to vertical frame members 42, 43, 44, and 45, respectively, of drive assembly frame 52. In the illustrated embodiment, lower sprockets 71 are non-powered "follower" sprockets used to define the lower portion of the pathway of chains 64.

Motive force for the lifting of ram 20 by chains 64 is ultimately provided by motor 24, shown in FIG. 4. In an exemplary embodiment, motor 24 is a hydraulic motor, which may be powered by hydraulic fluid flow delivered from the vehicle to which reciprocating hammer 10 is mounted (e.g., excavator 12 shown in FIG. 1) via fluid lines 26. In one exemplary embodiment, motor 24 may be an axial piston hydrostatic motor, such as a 6000 series motor from the Eaton Corporation of Dublin, Ireland. One particular exemplary motor is motor no. 112-1067-006, from the Eaton Corporation, which is rated to provide 1155 Nm of continuous torque and 1635 Nm of intermittent torque, which is sufficient to lift a 3000 lb ram 20 and compress accumulator 28 as described in further detail below.

Motor 24 is operably connected to gear box 84, which may be a direct transmission gear box or may be a speed reducer. As illustrated in FIG. 4, gear box 84 is mounted to top plate 36 of drive assembly frame 52. Motor power is output from gear box 84 via primary drive shaft 56, which is rotatably fixed to primary drive sprocket 57 to drive a pair of chains 54. Chains 54, in turn, drive intermediate input sprocket 59, which is rotatably coupled to one end of intermediate drive shaft 60 and supported by roller bearings 61 fixed to vertical frame members 42-45. Intermediate output sprocket 63 is rotatably fixed to the opposite end of drive shaft 60, and drives a pair of secondary chains 58. Chains 58, in turn, drive cam shaft input sprocket 65, which is fixed to one end of cam shaft 62 for rotation therewith. Cam shaft 62 is supported by roller bearings 94, affixed by cross members to respective vertical frame members 42-45.

Rotation of cam shaft 62 powers rotation of lifter chains 64 via lift chain sprockets 96 (FIGS. 11, 13 and 14), thereby transferring the motive force originally provided by motor 24 to chains 64 and lift bar 70 as noted above. In an exemplary embodiment, multiple stages (e.g., 2, 3 or 4 stages) of speed reduction are provided to reduce the rotational speed and increase the available torque input to cam shaft 62 as compared to the output from motor 24. In the illustrated embodiment, a first speed reduction may be provided by gear box 84 as noted above. A second speed reduction is provided by sizing intermediate input sprocket 59 larger than primary drive sprocket 57. A third speed reduction is provided by sizing cam shaft input sprocket 65 larger than secondary drive sprocket 57*a* (FIG. 2), which is rotatably fixed to intermediate drive shaft 60 and therefore driven by intermediate input sprocket 59, and sizing intermediate output sprocket 63 larger than cam shaft input sprocket 65, which are both rotatably fixed to tertiary drive shaft 62.

In an exemplary embodiment, total reduction of drive assembly 22 is between 2:1 and 30:1, such that cam shaft 62 rotates between two and thirty times slower than the output from motor 24 while providing between two and thirty times increased torque. However, any speed reduction may be chosen as needed for a particular application. In the illustrated embodiment, primary drive sprocket 57 is a 13-tooth sprocket, which drives sprocket 59 having 24 teeth (FIG. 4) for an initial reduction of 24:13. Sprocket 57*a* is an 11-tooth sprocket, which drives sprocket 65 having 24 teeth (FIG. 2) for an additional reduction of 24:11 and a total reduction of 576:143 or about 4:1.

Figure 7:
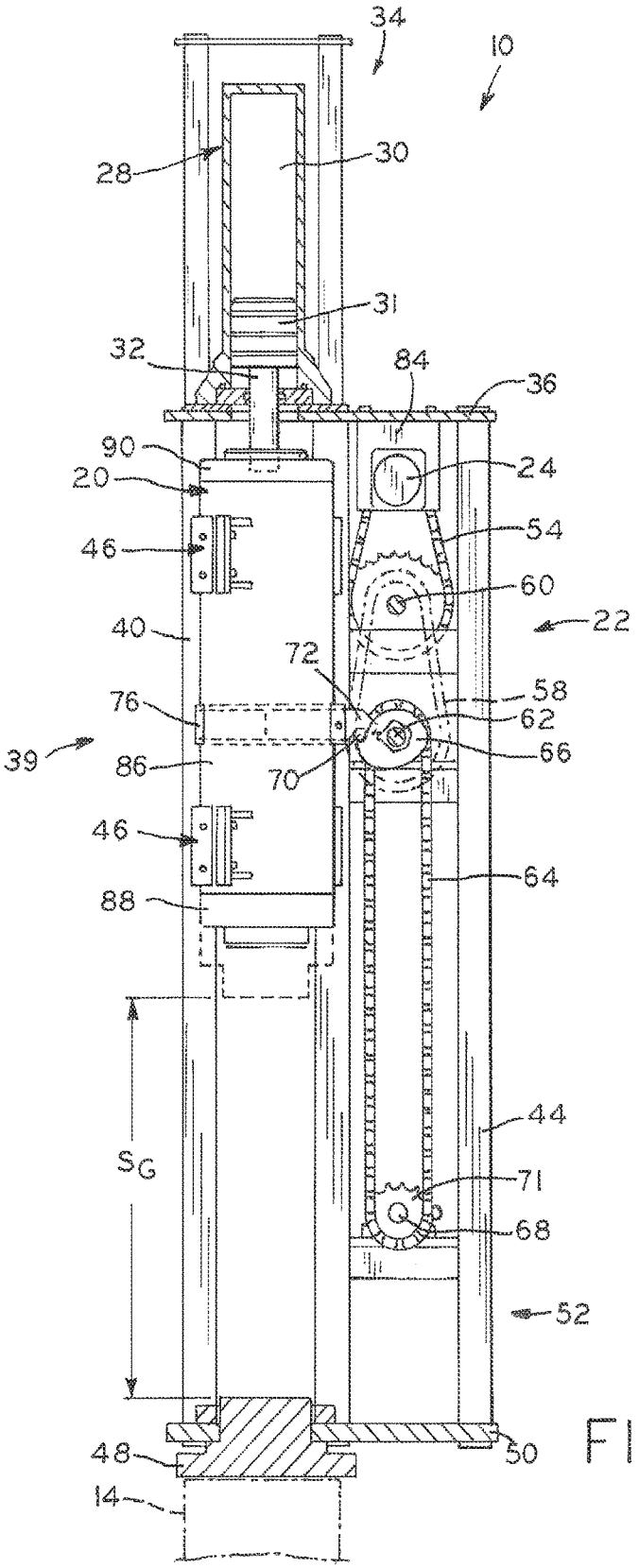
FIG. 7 is an elevation, cross-sectional view of the reciprocating hammer of FIG. 2, illustrating a configuration in which a pusher cam is initially engaged with the ram via the lift bar.

Turning now to FIG. 7, ram 20 is shown elevated through and slightly beyond its freefall stroke length $S_G$. At the stage of elevation shown in FIG. 7, chains 64 have lifted ram 20 to its intermediate position via lift bar 70 and lifter 76. In this initial lifting process, lift bar 70 is raised through a majority of the vertical extent provided by the drive pathway of lift chains 64 (i.e. along direction D), prior to engagement of lift bar 70 with cams 66. At the upper end of freefall stroke length $S_G$, lifter chains 64 cease to transmit the motive lifting force from motor 24 to ram 20. Instead, cams 66 engage lift bar 70 to provide such motive force transmission, as described in detail below.

Figure 11:
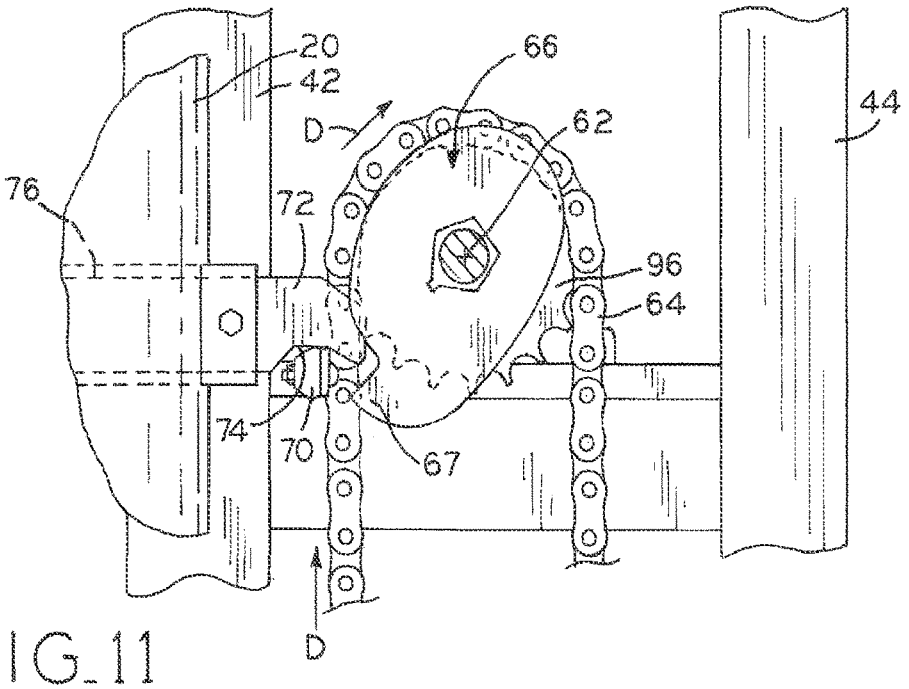
FIG. 11 is a elevation, partial cross-sectional view of the reciprocating hammer of FIG. 2, illustrating a pre-engagement configuration of the pusher cam.

Turning to FIG. 11, ram 20 is shown near the top of freefall stroke length $S_G$ (FIG. 7), with lift bar 70 still fully supported by chains 64 as they are driven along drive pathway D. However, it can be seen that cam lobe 67 of cam 66, which is rotating in a clockwise direction, it is nearing engagement with lift bar 70. Cams 66 are rotatably fixed to cam shaft 62, and are driven by motor 24 via the gear reduction mechanisms described above.

Figure 12:
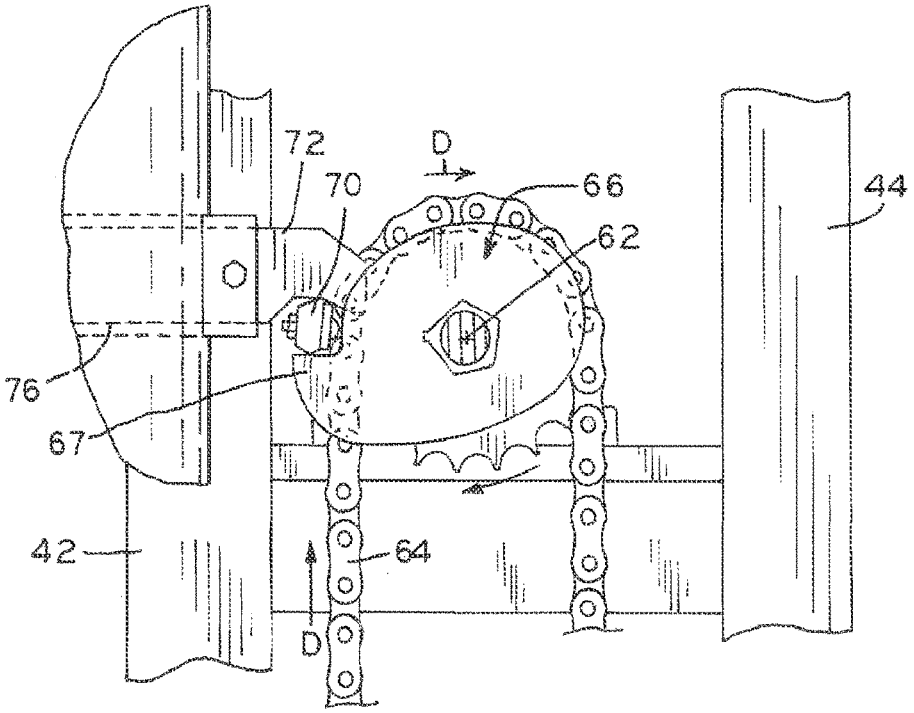
FIG. 12 is another elevation, partial cross-sectional view of the reciprocating hammer of FIG. 2, in which the pusher cam has initially engaged the lift bar.

Turning to FIG. 12, cam lobe 67 is shown after its initial engagement with lift bar 70 as cam 66 continues to rotate in a clockwise direction. At this point, much or all of the load previously supported by chains 64 becomes instead supported by cam 66. Because cam 66 is directly driven by cam shaft 62, chain 64 is relieved of its lifting duty at the upper end of freefall stroke length $S_G$.

Figure 13:
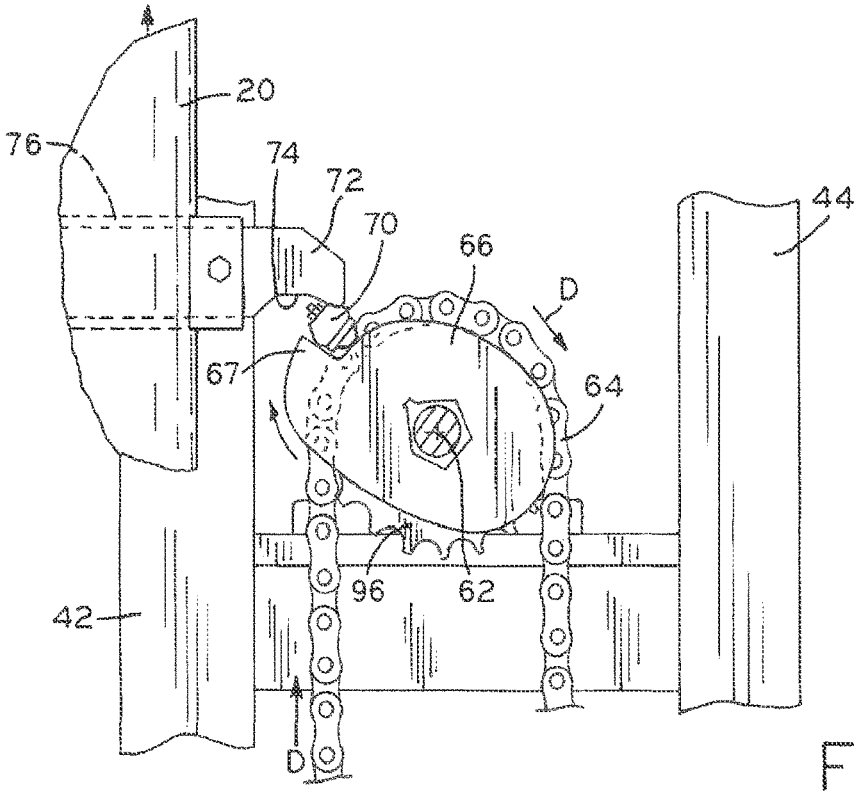
FIG. 13 is another elevation, partial cross-sectional view of the reciprocating hammer of FIG. 2, in which the pusher cam has lifted the lift bar.
Figure 13A:
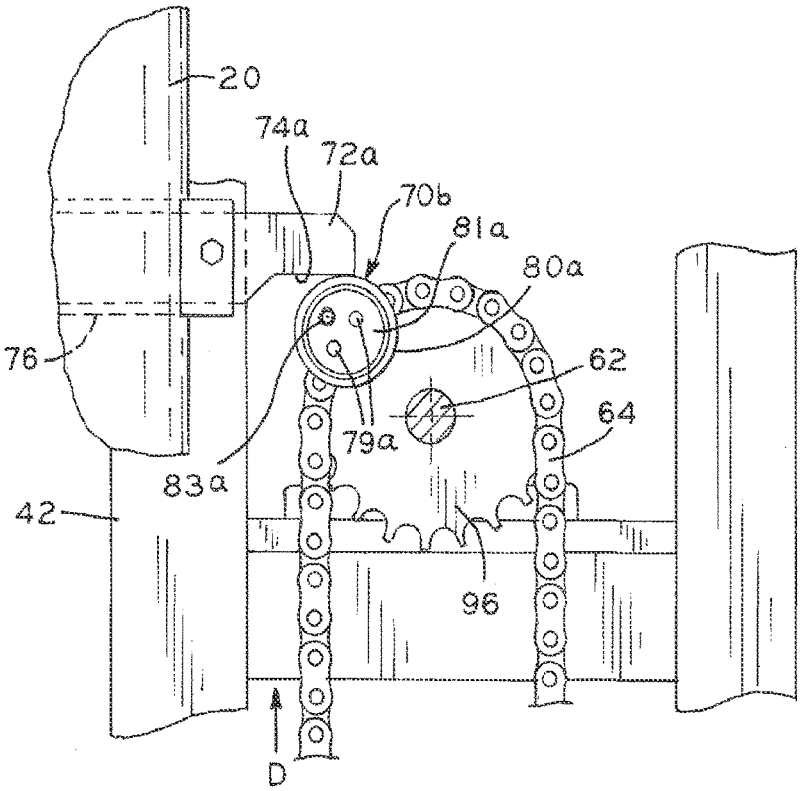
FIG. 13*a* is an elevation, partial cross-sectional view of the reciprocating hammer of FIG. 2 with an alternative lift mechanism including a roller, in which the roller is engaged with the ram.

In yet another alternative to lift bars 70 or 70*a*, roller assembly 70*b* shown in FIGS. 13*a* and 14*a* may be used as described in detail below.

2. Thrust Accumulator

FIG. 10, shows ram 20 in its impact position, after discharge of energy from thruster 20. In FIG. 10, assisted and total stroke lengths $S_A$ and $S_{AG}$ are shown in the context of ram 20 in its impact position (i.e., using the top of ram 20 as a point of reference) rather than the various raised positions of FIGS. 7 and 9 (i.e., using the bottom of ram 20 as point of reference), it being understood that both an upward and downward stroke of ram 20 traverses assisted, freefall and total stroke lengths $S_A$, $S_G$ and $S_{AG}$.

The lifting force required to elevate ram 20 past freefall stroke length $S_G$ and into assisted stroke length $S_A$ (FIG. 10) is increased owing to engagement of ram 20 with accumulator 28. Turning back to FIG. 7, it can be seen that upper cap 90 of ram 20 has engaged the distal (i.e., lower) end surface of piston rod 32, causing piston rod 32 and the associated piston 31 (which is fixed to piston rod 32) to advance upwardly and into chamber 30. In an exemplary embodiment, the distal (i.e., lower) end surface of rod 32 is made slightly convex, while the mating upper end surface of upper cap 90 is correspondingly concave. This ensures full surface contact between rod 32 and cap 90 during operation, even if there is slight axial misalignment between rod 32 and ram 20. This full surface contact promotes a full and complete transfer of energy from thruster 28 to ram 20. As described in further detail below, the upward advancement of rod 32 causes a compression of a quantity of gas contained within chamber 30, raising the amount of energy needed to elevate ram 20 by a given distance while also storing energy in accumulator 28 for subsequent discharge to ram 20 during its downward power stroke.

Turning back to FIG. 10, accumulator 28 is shown in the fully extended (i.e., fully discharged) position. In this position, chamber 30 defines an overall axial extent (i.e., chamber height) $S_{TE}$, which in conjunction with the cross sectional area of chamber 30 defines the interior volume thereof. In one exemplary embodiment, extended chamber height $S_{TE}$ is approximately eighteen inches, while the cross section of chamber 30 is a circle having a diameter of approximately nine inches. Chamber 30 is charged with a quantity of inert gas, such as nitrogen, and is further charged with a relatively incompressible fluid, such as hydraulic fluid (e.g., via a check-valve port provided in the shell of accumulator 28). A charge of gas and fluid are introduced into chamber 30 in sufficient amounts to create a precharged pressure, which in one embodiment may be about 1,000 psi. In other embodiments, the precharged pressure may be, for example, as low as 10, 100, 200 or 300 psi, or as much as 700, 1000, 1200, 1600 psi, or may be any value within any range defined by any of the foregoing pressures.

Piston 31 forms a fluid tight seal with the adjacent wall of chamber 30 (e.g., through the use of piston rings disposed between piston 31 and the adjacent wall of chamber 30) to hermetically seal chamber 30. Chamber 30 remains hermetically sealed throughout operation of accumulator/thruster 28 (i.e., throughout cycling of piston 31 between compressed and extended positions), such that no gas or other fluid can be introduced into chamber 30 or removed therefrom during operation of accumulator 28. That is to say, accumulator 28 does not include any valves, ports or other apertures designed to admit or exhaust working fluid as piston 31 and piston rod 32 cycle between extended and compressed positions. Rather, the quantity of gas and/or liquid contained within chamber 30 does not change after the precharging quantity of the same is introduced, such that the quantity of gas and liquid remain constant throughout operation of accumulator 28. Moreover, this lack of valves and constant quantity of fluid obviates the need for any external controls or other active intervention in the operation of accumulator 28 during operation of reciprocating hammer 10. To the extent that a control system is used in connection with reciprocating hammer 10, it controls only the operation of motor 24 and not the operation of accumulator 28.

Turning back to FIG. 7, it can be seen that piston rod 32 has been pushed from its extended position inwardly into chamber 30 by ram 20, thereby advancing piston 31 upwardly and reducing the volume of chamber 30. As this volume is reduced, the pressure of the gas contained within chamber 30 increases in an inverse relationship to the reducing volume, thereby storing potential energy which is releasable by allowing piston 31 and piston rod 32 to extend back to their fully extended configurations. The mechanical work necessary for this energy storage originates with motor 24, which provides the motive force for the upward travel of ram 20 as described in detail above. In order to insulate lift chains 64 from having to perform this additional mechanical work, cam 66 transfers the work performed by motor 24 to ram 20 and concomitantly to accumulator 28.

As shown in FIGS. 23-27 and described in further detail below, accumulator/thruster 28 may alternatively take the form of a spring or a set of springs (shown as accumulators 228A-228C in their respective figures) which are positioned to store energy by compressing such springs as ram 20 is lifted through assisted stroke length $S_A$, and then extend to discharge the stored energy to ram 20 in a similar fashion to accumulator/thruster 28. It is contemplated that any of accumulators 28, 228A, 228B or 228C may be used in conjunction with any of the reciprocating hammer embodiments described herein, as required or desired for a particular application. Moreover, because accumulators 228A-228C are compatible with the overall design of hammer 10 except as otherwise stated herein, reference to the structure, function and physical arrangement of accumulator 28 with respect to reciprocating hammer 10 can also be considered a reference to accumulators 228A-228C.

Figure 8:
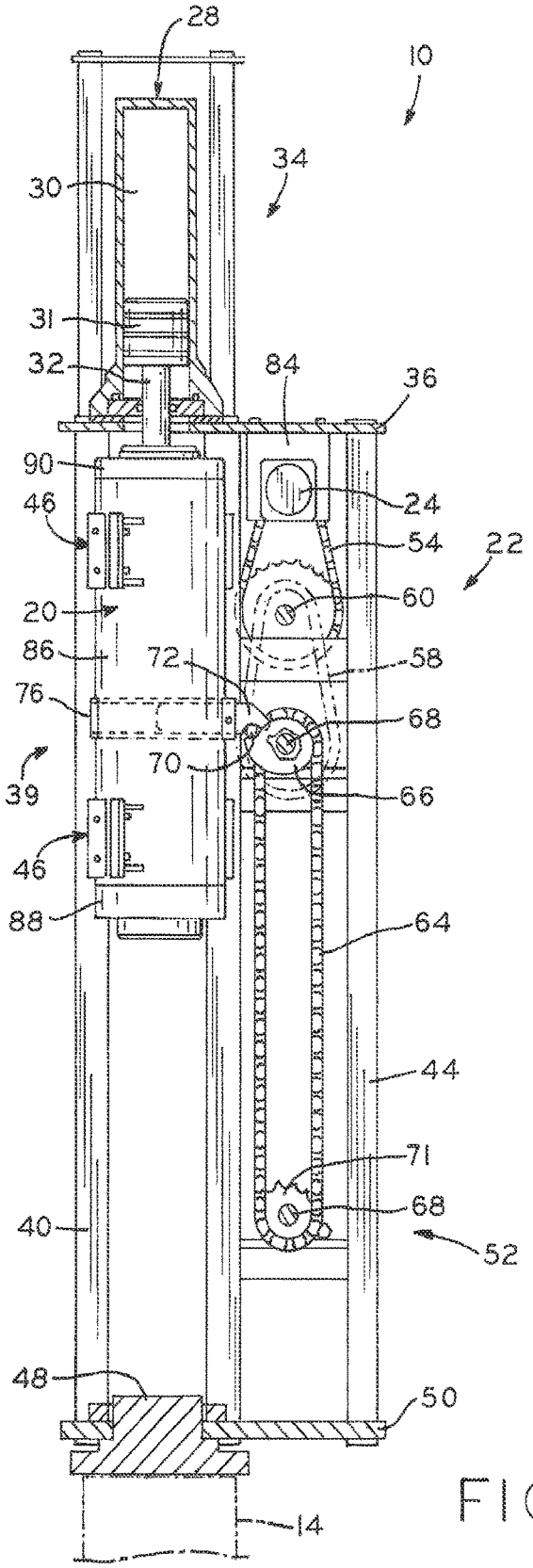
FIG. 8 is another elevation, cross-sectional view of the reciprocating hammer of FIG. 7, in which the pusher cam has further lifted the ram and compressed the charge of the thruster.

As noted above, FIGS. 8 and 12 illustrate the initial interaction between cam 66 and ram 20 via lift bar 70 and lifter 76, which in turn initially raises ram 20 and compresses accumulator 28. Turning to FIGS. 9 and 13, cam 66 is shown further rotated in a clockwise direction, which elevates cam lobe 67 and further raises lift bar 70 and therefore ram 20. Piston 31 has advanced further into chamber 30, further reducing the overall volume of chamber 30 and correspondingly increasing the pressure of the gas contained therein and its associated stored potential energy.

Figure 14:
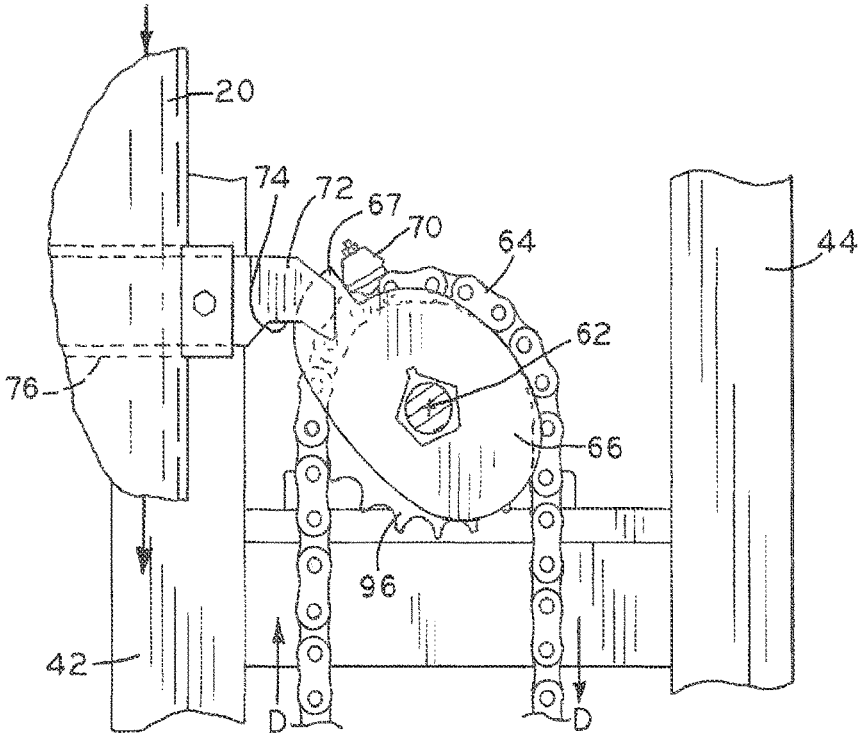
FIG. 14 is another elevation, partial cross-sectional view of the reciprocating hammer of FIG. 2, in which the pusher cam has disengaged from the lift bar.
Figure 14A:
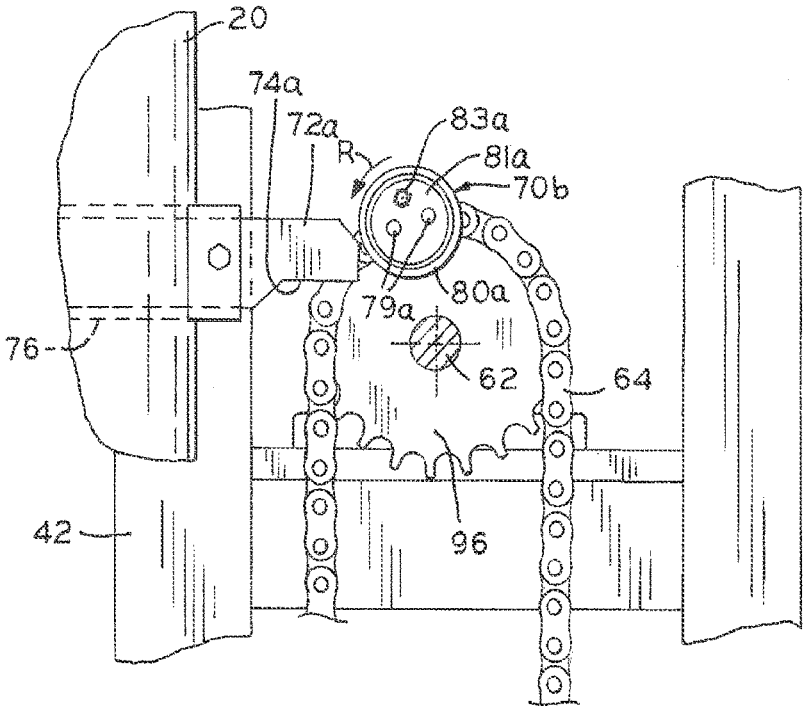
FIG. 14*a* is another elevation, partial cross-sectional view of the reciprocating hammer of FIG. 13*a*, in which the roller has disengaged from the ram.

FIG. 9 illustrates the inflection point at which ram 20 has reached a fully raised position and accumulator 28 has achieved a fully compressed configuration, while FIG. 14 illustrates the moment after the inflection point during which ram 20 has begun its fall. FIG. 9 illustrates compressed chamber height $S_{TC}$, which is less than expanded chamber height $S_{TE}$ (FIG. 10) by a predetermined amount. In one exemplary embodiment, $S_{TE}$ minus $S_{TC}$ equals about twelve inches, which corresponds to an increase in pressure within chamber 30 from 1,000 psi to 3,000 psi. In the illustrated embodiment, all of this twelve-inch stroke is utilized to accelerate ram 20 as described herein, but it is contemplated that stroke utilization can be adjusted as needed for a particular design by modifying the vertical position of accumulator 28, and/or the vertical position of cam shaft 62 (and therefore the vertical position of the top of the ram stroke).

If the alternative lift bar 70*a* (FIG. 16) is used in place of lift bar 70, cam lobes 67*a* engage body 83 of C-clamps 81 rather than the direct engagement of cam lobes 67 with lift bar 70 as described above. Thus, rotation of cams 66*a* driven by rotation of cam shaft 62 engages cam lobes 67*a* with C-clamps 81, such that cam lobes 67*a* abut a lower corner of C-clamp body 83 and the substantially planar surface of body 83 abuts the correspondingly planar surface of cam 66*a* adjacent to cam lobes 67*a*. The resulting force-transferring relationship between cams 66*a* and C-clamps 81 operate to lift C-clamps 81 and lift bar 70*a* as cams 66*a* rotate, thereby lifting ram 20 through assisted stroke length $S_A$ in a similar manner as described above. After the lifting operation of ram 20 is complete, lift bar 70*a* continues rotating around sprocket 96 (FIG. 14) and begins its downward travel as chains 64 continue their circuit. Advantageously, the disengagement of cam lobes 67*a* from C-clamp body 83 as lift bar 70*a* begins to move away from sprocket 96 is facilitated by the geometry and interaction of cam lobes 67*a* and C-clamps 81. Specifically, at the point of separation between cam lobes 67*a* and body 83, the interaction therebetween does not create a radially inward force which would tend to drive lift bar 70*a* away from the circuit of chains 64.

3. Roller Sleeve Lifter

In yet another alternative shown in FIGS. 13*a* and 14*a*, lift bars 70 or 70*a* and cams 66 or 66*a* may be omitted completely in favor of roller assembly 70*b*, which offers a strong lift mechanism and a low-friction ram release as further described below. Roller assembly 70*b* includes roller core 81*a* affixed to respective links of lift chains 64, and roller sleeve 80*a* rotatably received on roller core 81*a*. In the illustrated embodiment, roller core 81*a* is fixed to chains 64 (only one of which is shown in FIGS. 13*a* and 14*a*) via apertures 79*a*, which extend longitudinally through roller core 81*a* and are sized to receive extra long roller chain pins which span both lift chains 64 with roller core 81*a* received therebetween. These roller pins fix roller core to two neighboring links of each of chains 64, such that roller core 81*a* operates as a "master link" linking the otherwise free ends of chains 64 to form continuous chains 64 as illustrated.

Roller sleeve 80*a* is received upon roller core 81*a* and is rotatable around its longitudinal axis. In order to facilitate smooth rotation of sleeve 80*a* with respect to core 81*a*, especially under potentially heavy loads as described below, roller sleeve 80*a* may be mounted to roller core 81*a* via bearings and/or a lubricious surface. In the illustrated embodiment, grease fitting 83*a* is provided to inject and/or remove and replace grease into the interface between the inner surface of roller sleeve 80*a* and the mating outer surface of roller core 81*a* in order to mitigate friction therebetween and/or maintain lubrication in bearings. Grease fitting 83*a* may comprise a standard grease zerk.

In operation, roller assembly 70*b* engages lower surface 74*a* of lifter 72*a* as lift chains 64 advance along direction D (FIG. 13*a*), in similar fashion to the engagement of lift bar 70 with notch 74 of lift hook 72 described in detail above. Roller assembly 70*b* lifts ram 20 through its freefall stroke length $S_G$ (FIG. 7) in the same manner as lift bar 70. However, the arrangement of FIGS. 13*a* and 14*a* differs in its operation through assisted stroke length $S_A$. As noted above, cams 66 are omitted from the assembly such that lift chains 64 and roller assembly 70*b* provide the motive force for lifting ram 20 through assisted stroke length $S_A$ with no extra assistance from cams. Although this arrangement may require heavier-duty chains 64 and associated structures as compared to the system above including cams 66, the alignment of cams 66 with lift bar 70 (i.e., the "timing" of cams 66) is no longer necessary, which may obviate the need for adjustment of drive assembly 22 as chains 64 stretch over the course of their useful service life. In addition, the provision of roller assembly 70*b* without cams 66 facilitates efficient use of multiple roller assemblies 70*b* along the circuit of lift chains 64 (similar to the pair of lift bars 70 used with reciprocating hammer 10 as discussed above). Specifically, spacing between respective neighboring pairs of roller assemblies 70*b* need not be tailored to correspond with a particular number of complete rotations of lift chain sprocket 96 and cam 66. That is to say, because there are no cam timing requirements, roller assemblies 70*b* may be placed at any desired interval along lift chains 64, thereby potentially increasing the number of blows ram 20 may deliver to pile 14 (FIG. 1) during a given time interval (e.g., during one complete circuit of lift chains 64).

Roller assembly 70*b* also provides a crisp, low friction transition or "break" from the vertical lift through freefall and assited stroke lengths $S_G$, $S_A$ to the distengagement of roller assembly 70*b* from ram 20. This transition is shown by a comparison of FIGS. 13*a* and 14*a*, in which the former is approaching the top of the lift stroke and the latter is shown after the break as ram 20 begins to accelerate downwardly. As roller assembly 70*b* begins rotating around the axis of sprocket 96 and drive shaft 62 during the final stages of assisted stroke length $S_A$, roller assembly 70*b* begins to move laterally away from lifter 72*a*. During this lateral movement, roller sleeve 80*a* is allowed to rotate with respect to roller core 81*a* to establish a low-friction rolling contact between roller sleeve 80*a* and lower surface 74*a* of lifter 72*a*, as opposed to a higher friction sliding contact that would occur if roller sleeve 80*a* were not rotatable. Thus, as roller assembly 70*b* continues its lateral motion away from lifter 72*a* and disengages therefrom, roller sleeve 80*a* rotates along direction R (FIG. 14*a*) to maintain such rolling contact until disengagement. At this point, the break has occurred and ram 20 is allowed to travel through its assisted and freefall stroke lengths as $S_A$ and $S_G$ to deliver a blow to pile 14, as described in detail above.

Although the embodiment of reciprocating hammer 10 lacking cams 66 or 66*a* is shown with roller assembly 70*b* and the embodiment including cams 66 or 66*a* is shown with lift bars 70 or 70*a*, it is contemplated that these structures may be interchanged. That is, roller assembly 70*b* may be used in embodiments including cams 66 or 66*a*, while lift bars 70 or 70*a* may be used in embodiments lacking cams 66 or 66*a*.

A pair of roller assemblies 70*b* may also be used in conjunction with a corresponding pair of lifters 76 to increase the overall vertical stroke of ram 20, as shown in FIGS. 22-23 and 26-27. An first roller assembly 70*b* engages a first lifter 76 when ram 20 is at the bottom of its stroke, and begins to lift ram 20 as described above. A second roller assembly 70*b* is spaced apart from the first roller assembly 70*b* along lifter chain 64 by a distance equal to or slightly larger than the corresponding vertical distance between the first and second lifters 76, such that the second, lower roller assembly 70*b* comes into engagement or near-engagement with the second, lower lifter 76 as ram 20 is lifted. After the upper roller assembly 70*b* disengages from the upper lifter 76 as described in detail above, the lower roller assembly 70*b* remains engaged with the lower lifter 76 and continues to lift ram 20 to a higher level prior to disengaging, at which point ram 20 begins its downward stroke as described above.

As described in detail below with respect to the spring-biased thrust accumulator embodiments of FIGS. 23-27, special accommodations may be made in hammers 10, 110, and/or 210 to allow for the increased vertical stroke of ram 20 when used with the illustrated pair of roller assemblies 70*b*. However, it is contemplated that any of the illustrated embodiments of the present disclosure may be used with the pair of roller assemblies 70*b* and lifters 76 as required or desired for a particular application. In addition, although roller assemblies 70*b* are shown for purposes of illustration, it is contemplated that lift bars 70 or 70*a* may be used as a pair in conjunction with the pair of lifters 76 as required or desired. Moreover, embodiments including cams 66 or 66*a* may also be used in cooperation with a pair of lifters 70, 70*a* or roller assemblies 70*b*, with the timing of cams 66 or 66*a* set to engage one or both of the pair lifters 70, 70*a* or roller assemblies 70*b* at the appropriate time.

4. Accelerated Ram

All of the above-described lifter embodiments have the power to both lift ram 20 and compress accumulator 28 to store acceleration energy. The amount of stored energy available, and therefore the sizes and strength ratings chosen for the components of drive assembly 22, may be set to any nominal value as required or desired for a particular application. As noted above, in an exemplary embodiment the cross sectional area of chamber 30 is a circle having a diameter of about nine inches, which equates to a nominal cross-sectional area of about 63.6 square inches. Thus, the increased gas pressure in chamber 30 associated with lifting ram 20 through its assisted stroke length $S_A$ results in a directly (i.e., substantially linearly) correlated increase in thrust force from 63,617 pounds to 190,852 pounds upon piston 31, substantially all of which can be transferred to ram 20 to urge ram 20 in a downward direction. This results in the average thrust force applied by thruster 28 to ram 20, over its one-foot stroke, of (190,825 lbs−63,617 lbs)=127,235 lbs. Given that thruster 28 operates over a one-foot stroke in this exemplary configuration, total energy imparted is (127,235 lbs×1 foot)=127,235 foot-pounds.

In addition to modifying the total available or utilized stroke length of accumulator 28, it is also contemplated that the gas pressure and/or cross-sectional area associated with chamber 30 may be modified to change the amount of thrust-assist energy provided by thruster 28, as required or desired for a particular application. For example, an accumulator designed for use with a larger version of reciprocating hammer 10 and/or a heavier version of ram 20 may have a chamber with a correspondingly larger cross-sectional area and/or charge pressure in order to deliver additional thrust assist as may be needed with a scaled-up application, or vice-versa.

Figure 20:
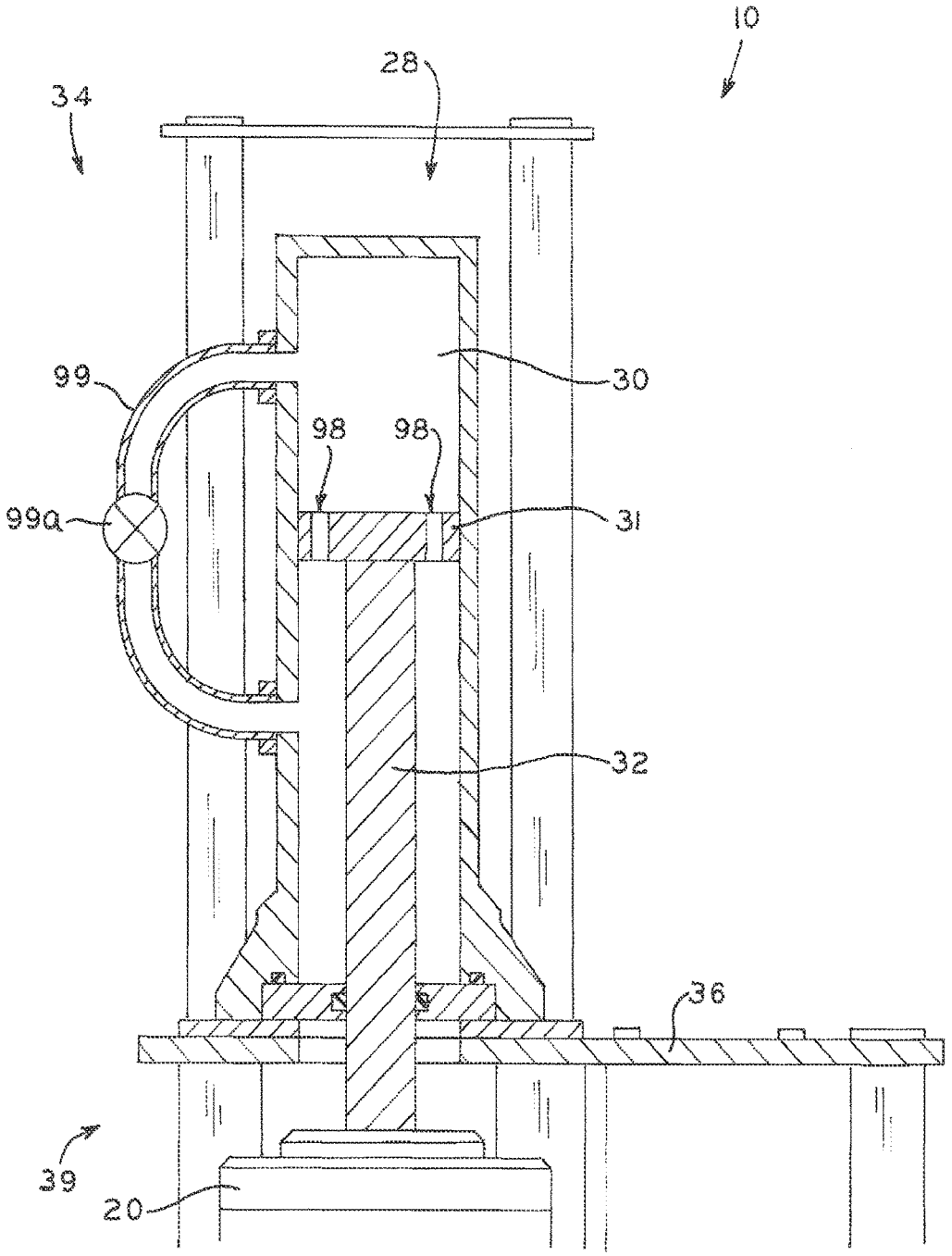
FIG. 20 is a partial elevation, cross-section view of an alternative accumulator for use with a reciprocating hammer in accordance with the present disclosure.

In another embodiment shown in FIG. 20, accumulator 28 may include damping to slow its downward acceleration, thereby lengthening the amount of time during which energy is transferred from thruster 28 to ram 20. Such damping may be effected by forming small holes 98 in piston 31, through which a working fluid such as hydraulic oil must pass during the downward motion of piston 31 within chamber 30. In this arrangement, the size and number of holes 98 may be varied to control the speed at which fluid may be forced therethrough, thereby setting the speed at which piston 31 and piston rod 32 extend dowardly during the initial acceleration of ram 20. In an alternative arrangement, a hydraulic line 99 may extend between two orifices provided in the sidewall of accumulator 28, with one orifice above and one orifice below the stroke of piston 31. Thus, when piston 31 moves downwardly, fluid is forced through hydraulic line 99. The speed at which fluid is allowed to flow through this fluid line (controllable, e.g., with a valve 99*a* in the fluid line) controls the maximum speed of piston 31 (and piston rod 32) during acceleration of ram 20.

At the instant reciprocating hammer 10 reaches the configuration shown in FIG. 9, lift bar 70 has disengaged from notch 74 of lift hook 72, thereby freeing ram 20 to begin its downward travel toward the impact position. In FIG. 14, the initial portion of this downward travel is illustrated.

The freefall stroke length $S_G$ has thus been augmented by an assisted stroke length $S_A$ for a total stroke length $S_{AG}$ as shown in FIG. 9. The point at which the assisted stroke length $S_A$ ends and the freefall stroke length $S_G$ begins can be thought of as an "intermediate" ram position between its fully raised position and its impact position. As ram 20 travels downwardly from the fully raised position to the intermediate position, piston 31 and piston rod 32 are allowed to travel downwardly under the force of pressure within chamber 30, releasing its stored energy in the form of work performed on ram 20. As this work is performed, ram 20 is accelerated by the stored energy, in addition to further acceleration under the force of gravity alone. Thus, where the total stroke length of accumulator 28 is about twelve inches, the first twleve inches of downward travel of ram 20 is the assisted stroke length thereof. In this exemplary embodiment, this amount of work imparts an additional 127,235 foot-pounds of energy to ram 20 in addition to the energy resulting from its gravitational acceleration.

After ram 20 passes the intermediate position, it enters the freefall stroke length $S_G$ and begins the remainder of its downward travel toward the impact position, at which point the leading surface of lower cap 88 of ram 20 impacts anvil 48, which in turn transfers the full accumulated energy of ram 20 to pile 14.

Accumulator 28 transitions from its energy accumulation functionality at this point to thruster 28 which imparts the accumulated energy back to ram 20 as the volume within chamber 30 is allowed to reexpand. For purposes of the present disclosure, "accumulator" and "thruster" are used interchangeably to refer to the same device, it being understood that the device performs the function of energy accumulation while being compressed and energy discharge while extending.

After ram 20 has delivered its energy to anvil 48, the cycle may begin again in which ram 20 is again lifted from the impact position to the intermediate position by lifter chains 64, and then from the intermediate position to the fully raised position by, e.g., cams 66. In order to shorten the overall cycle time, lift chains 64 may be provided with a second lift bar 70 opposite the first lift bar 70, as shown in FIG. 10, so that the upper lift bar 70 which was just released from lifter 76 of ram 20 has disengaged, the second lift bar 70 is already rounding the turn of lower sprocket 71 to begin lifting ram 20 once again.

Thus, reciprocating hammer 10 provides a two-stage power stroke in which initial acceleration of ram 20 is augmented by energy stored by accumulator 28. This allows for increased impact delivery within a given overall stroke length $S_{AG}$ and a given weight of ram 20.

In one embodiment, drive assembly 22 is structured to deliver this increased energy with little minimal increases in load carrying capacities of several drive components. For example, lifter chains 64 may be provided to the same specification in reciprocating hammer 10 as would be provided in a similar reciprocating hammer which utilizes gravity alone to accelerate ram 20. Specifically, lifter chains 64 may be sized and specified to have a relatively lower load limit sufficient only to raise the weight of ram 20, but not to provide the additional energy needed to compress piston rod 32 and piston 31 into chamber 30 of accumulator 28. In order to provide the additional load capacity for such compression, cams 66 may be specified to have a second, higher load limit sufficient to both lift ram 20 and compress accumulator 28 while relieving chains 64 of this heavy duty. Cams 66, being solid structures made of monolithic steel or other metal, can easily and cost effectively bear this weight, while lifter chains 64 can span the relatively longer distance needed to raise ram 20 throughout most of the two-stage stroke length $S_{AG}$.

This two-stage approach illustrated in, e.g., FIGS. 7-14 reduces the weight and cost of reciprocating hammer 10 for a given potential impact delivery, by allowing the use of a motor and chain combination that are substantially lighter-duty, and therefore lighter weight, as compared to what would be required for a conventional single-stage system of comparable power. Moreover, because such a conventional single-stage system would typically a longer stroke length to deliver impact power comparable to reciprocating hammer 10, the overall height of reciprocating hammer 10 can be reduced as compared to conventional designs. In other exemplary embodiments, such as those illustrated in FIGS. 13*a*, 14*a*, 17-19*c*, 22-23 and 26-27, a two-stage lift approach may be used without cams 66 as described in detail herein.

In exemplary embodiments, the assisted stroke length $S_A$ is as little as one inch, two inches, or three inches and as much as twelve inches, eighteen inches or twenty-four inches, or may be within any range defined by any of the foregoing values. By contrast, the freefall stoke length $S_G$ may be at least two feet, three feet, or four feet, and may be as much as five feet, six feet or ten feet, or maybe within any range defined by any pair of the foregoing values. In an exemplary embodiment, assisted stroke length $S_A$ is equal to no more than 50%, and in many cases less than 25%, of the overall stroke length $S_{AG}$, while still retaining the mechanical capacity to increase energy delivery of ram 20 as noted above.

For embodiments including cams 66, the dual stage drive mechanisms provided by lifter chains 64 in one stage and cams 66 in another stage facilitate raising ram 20 through its entire two-stage stroke length $S_{AG}$ using only one motor 24. Specifically, gear box 84, primary chain 54 and second chain 58 may all be sized and specified to handle the maximum load applied to cam shaft 62 (i.e., during the final stage of lifting ram 20 through assisted stroke $S_A$). Owing to the reductions provided by these initial stages and the relatively shorter chain lengths associated with these stages, this high capacity can be provided throughout the gearing mechanism between motor 24 and cam shaft 62 for a relatively low cost and with relatively lighter weight.

For embodiments excluding cams 66, a single motor 24 may still be used with gear reductions as needed to raise ram 20 through its entire two-stage stroke length $S_{AG}$ in a similar fashion.

5. Jump Arrestor

In some embodiments, the upward force exerted on frame 39 of hammer 10 during the release of stored energy from thruster 28 (i.e., during assisted stroke length $S_A$ of ram 20) exceeds the opposing downward force provided by the weight of frame 39 and its various attached structures. In addition, reciprocating hammer 10 may be slidably mounted to boom 16 via mounting bracket 19, as shown in FIG. 1 and described above, such that frame 39 is not vertically "anchored" in position atop pile 14 by anything other than its own weight. In this configuration of reciprocating hammer 10, frame 39 and its attached structures may "jump" upwardly during the initial acceleration of ram 20 as thruster 28 releases its energy. That is to say, the upward force released by thruster 28 during initial acceleration of ram 20 is greater than the counteracting weight of ram frame 39 and all the components fixed thereto, such that the accumulator briefly "lifts" ram frame 39 and its fixed components upwardly. As described in detail below with respect to FIGS. 17-19*c*, this condition may be mitigated or eliminated by providing jump arrestor assembly 100, which operates to oppose any upward lift of ram frame 39 by providing a counteracting downward force as described below.

Figure 17:
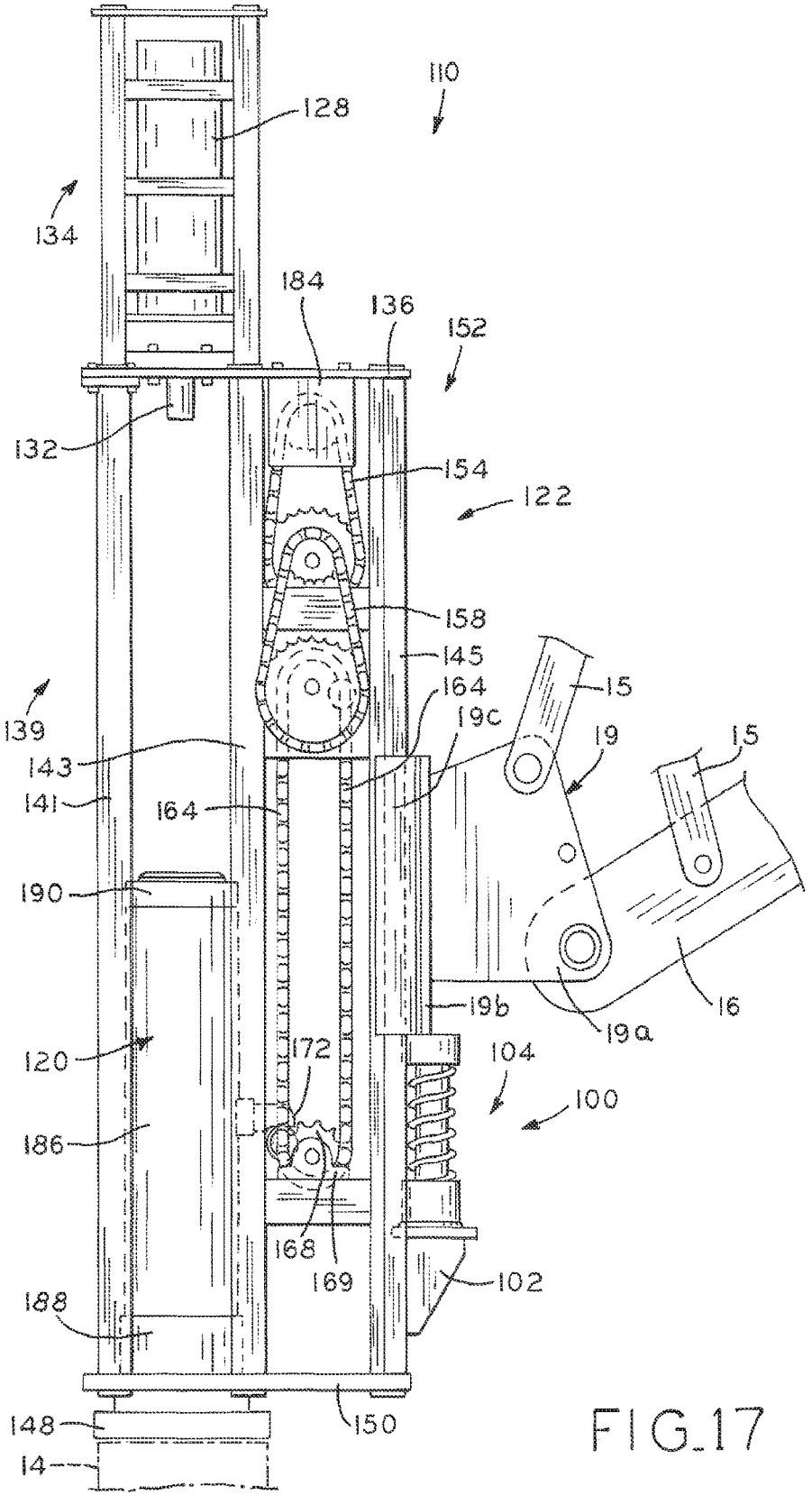
FIG. 17 is an elevation view of an alternative reciprocating hammer in accordance with the present disclosure, including a jump arrestor mechanism.

Turning now to FIG. 17, an alternative reciprocating hammer 110 is shown which is configured with a high-powered accumulator 128 capable of exerting discharge forces sufficient to cause an upward jump of the frames and associated structures of hammer 110. Reciprocating hammer 110 is similar to reciprocating hammer 10 described above, and structures of hammer 110 are analogous to corresponding structures of hammer 10 and denoted with a common reference number, except with 100 added thereto. Except as otherwise set forth herein, the structures of hammer 110 are identical or substantially unchanged from their counterparts in hammer 10, and the features, functions and uses of hammer 10 also apply to hammer 110.

However, reciprocating hammer 110 includes jump arrestor assembly 100 positioned and configured to minimize or eliminate upward movement of the structures and frames of hammer 110 during the initial discharge of stored energy from accumulator 128 as ram 120 is accelerated through assisted stroke length $S_A$ (FIG. 9 illustrates assisted stroke length $S_A$ in the context of reciprocating hammer 10). Jump arrestor 100 includes at least one shock absorber 104 operably interposed between ram frame 139 and mounting bracket 19 at the distal end of boom 16 of excavator 12 (FIG. 1), such that any tendency of reciprocating hammer 110 to advance upwardly away from pile 14 (i.e., to "jump") compresses shock absorber 104 and thereby transfers force to excavator 12 via distal bracket 19. Because excavator 12 is much larger and heavier than hammer 110, this transfer of force to excavator 12 arrests or substantially prevents upward movement of hammer 110, as described in further detail below.

Figure 18:
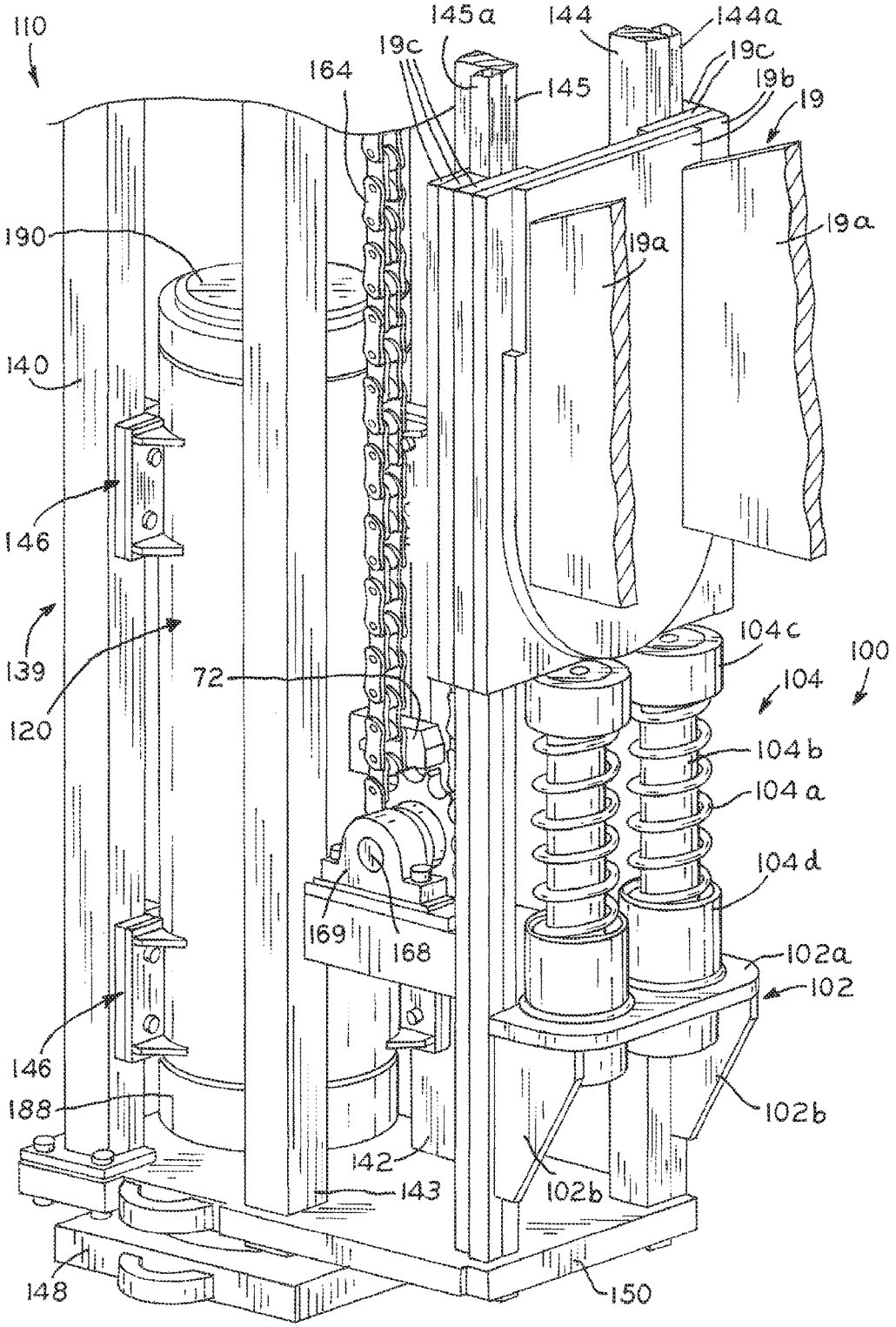
FIG. 18 is an enlarged perspective view of a portion of the reciprocating hammer of FIG. 17, illustrating the jump arrestor mechanism.

FIG. 18 illustrates an exemplary arrangement of jump arrestor assembly 100 including a pair of shock absorbers 104 mounted to mounting base 102 and engaged with distal bracket 19. In the illustrated embodiment, mounting base 102 includes mounting platform 102*a* spanning the lateral distance between vertical frame members 144, 145 and welded thereto. Stiffener plates 102*b* are welded to the undersurface of mounting platform 102*a* along each of vertical frame members 144, 145 to enhance the load bearing capacity of mounting base 102.

Shock absorbers 104 are illustrated as a "coil over" type design, including coil springs 104*a* received over and axially aligned with respective spring guides 104*b*. Springs 104*a* are each captured between an upper end cap 104*c* affixed to an upper end of guide 104*b*, and an upper surface of mounting platform 102*a*. Spring retainers 104*d* are affixed to the upper surface of mounting platform 102*a* to maintain coil springs 104*a* in axial alignment with guides 104*b* during compression and extension, as further described below. Although coil-type springs 104*a* are illustrated as an exemplary biasing element, it is contemplated that other biasing elements may be employed such as leaf springs, resiliently deformable polymer materials, and the like.

Referring still to FIG. 18, distal bracket 19 includes a pair of boom mounting plates 19*a* sized and positioned to pivotably receive boom 16 and linkage arms 15 (FIG. 17), and are fixed (e.g., by welding) to one or more frame mounting plates 19*b*. One or more low-friction frame sliders 19*c* are slidably captured upon vertical frame members 144, 145 via slider rods 144*a*, 145*a*, respectively to facilitate vertical movement of distal bracket 19 along vertical frame members 144, 145 of ram frame 139. Additional detail regarding an exemplary sliding attachment of distal bracket 19 to frame members 144, 145 is described in U.S. Pat. No. 7,387,173 filed Mar. 7, 2006 and entitled Pile Driver, the entire disclosure of which is hereby incorporated by reference herein for all that it teaches and for all purposes.

With anvil 148 of hammer 110 resting upon the underlying pile 14 (shown in FIG. 19*a* and described below), distal bracket 19 may be slidably lowered along frame members 144, 145 until the lower edges of frame mounting plates 19*b* abut upper end surfaces of shock absorbers 104, as illustrated. When so abutting, upward movement of ram frame 139 or downward movement of bracket 19 is resisted by compression of coil springs 104*a*.

Figure 19C:
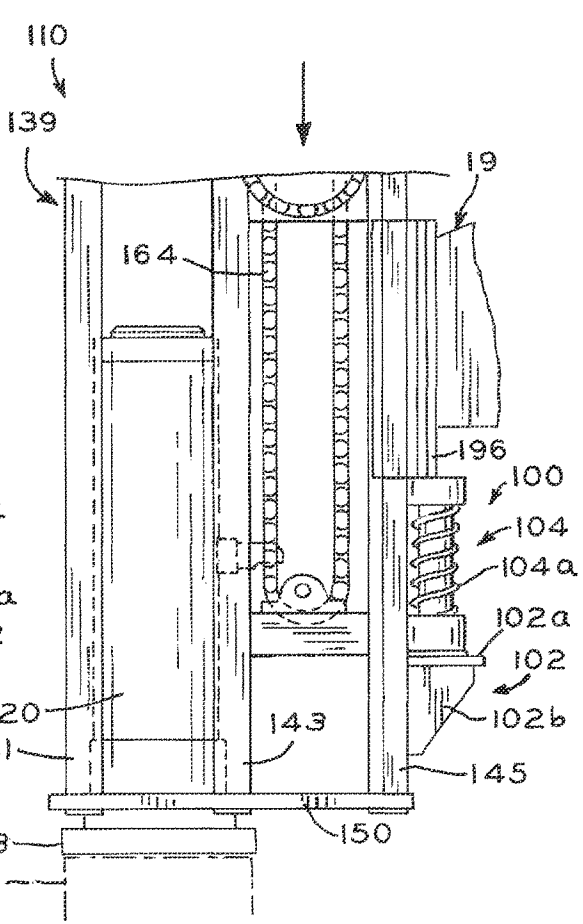
FIG. 19*c* is another view of the reciprocating hammer of FIG. 19*b*, in which the shock absorber of the jump arrestor is fully extended after further downward movement of the pile and reciprocating hammer assembly.
Figure 19B:
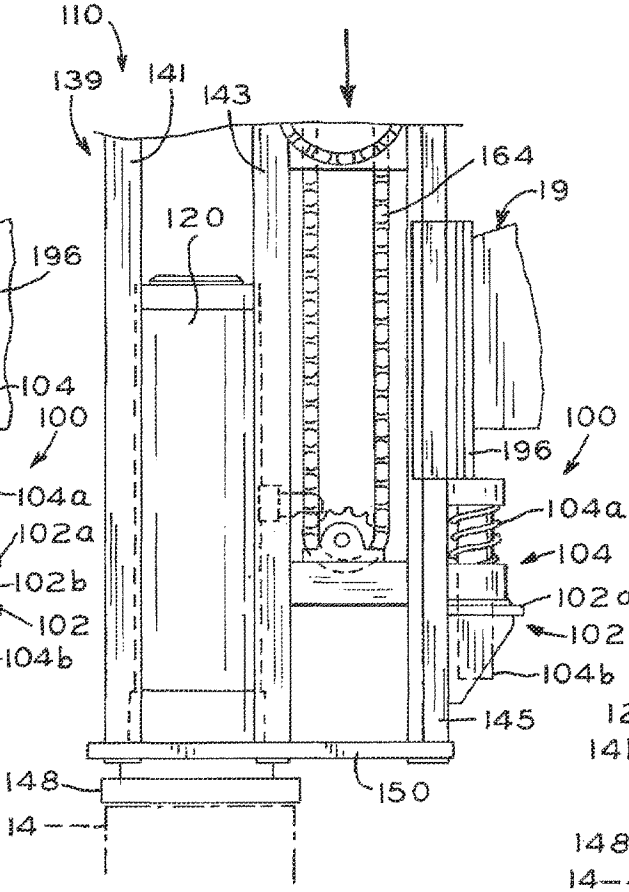
FIG. 19*b* is another view of the reciprocating hammer of FIG. 19*a*, in which the shock absorber of the jump arrestor is partially extended after downward movement of the pile and reciprocating hammer assembly.
Figure 19A:
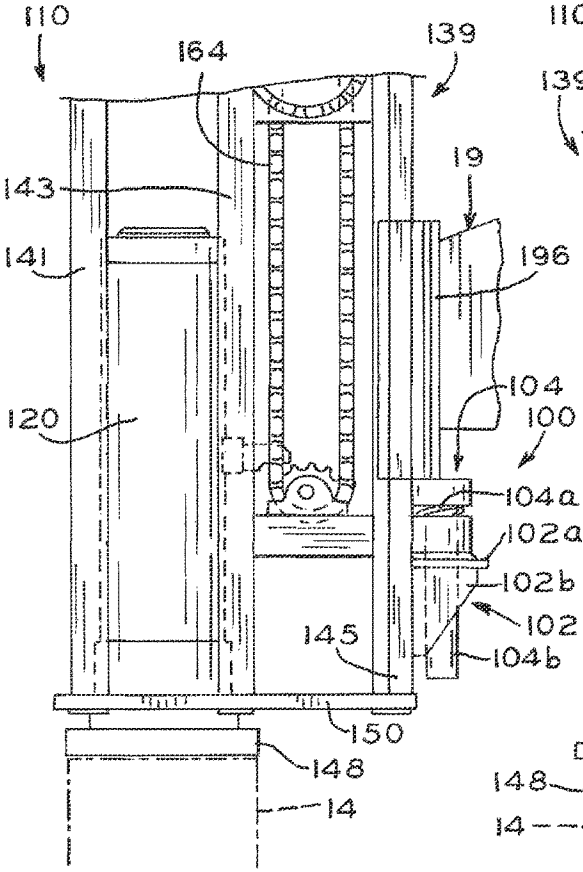
FIG. 19*a* is an enlarged, partial elevation view of the reciprocating hammer of FIG. 17, in which a shock absorber of the jump arrestor is fully compressed.

The use of a reciprocating hammer 110 in driving pile 14 is shown in FIGS. 19*a*-19*c*, which illustrate the progressive downward travel of pile 14 throughout multiple blows from ram 120. First, anvil 148 of hammer 110 is engaged with an upper end of a pile 14 to be driven into ground G, as shown in FIG. 1 and described in detail above with respect to reciprocating hammer 10. Once reciprocating hammer 110 is engaged and properly aligned with pile 14 as shown in FIG. 19*a*, mounting bracket 19 is advanced downwardly along its allowed slidable travel with respect to ram frame 139 by boom 16, compressing coil springs 104*a* to their fully compressed configuration as illustrated in FIG. 19*a*. As this compression occurs, spring guides 104*b* are allowed to travel downwardly through appropriately sized apertures formed in mounting platform 102*a* of mounting base 102.

Drive mechanism 122 (FIG. 17) is then activated to lift ram 120 and compress accumulator 128, as described in detail above with respect to reciprocating hammer 10, and ram 120 is then allowed to accelerate and fall downwardly, striking a blow to anvil 148 and driving pile 14 into ground G (FIG. 1). With the initial blow, when hammer 110 is in the configuration of FIG. 19*a*, any tendency of ram frame 139 to jump upwardly may be directly counteracted by boom 16 and vehicle 12 because springs 104*a* are fully compressed.

The process of using ram 20 to strike blows to pile 14 continues iteratively, with pile 14 moving further downwardly with each blow from ram 120. With each initial acceleration of ram 120 under the influence of accumulator 128, ram frame 139 and its associated structures may begin to "jump" upwardly as described above. As frame 139 begins its upward travel, springs 104*a* compress further and provide a counteracting downward force, thereby arresting the upward motion of frame 139. In some instances, the spring rate of springs 104*a* may combine with the weight of reciprocating hammer to prevent such upward movement completely. If some amount of "jump" is permitted, the spring rate may be chosen to be high enough to ensure that anvil 148 is firmly seated back on pile 14 by the time ram 120 has traveled through its stroke length $S_{AG}$, so that ram 120 may deliver the full force of its momentum to pile 14.

As pile 14 moves downwardly, reciprocating hammer 110 is allowed to move downwardly to maintain contact between anvil 148 and the upper surface of pile 14, as shown in FIG. 19*b*. However, mounting bracket 19 may be kept stationary by the operator of excavator 12, with no need for readjustment after each blow of ram 120. In particular, the spring stroke afforded by shock absorbers 104 allows ram frame 139 to advance downwardly, while the jump arrestor functionality of assembly 100 continues to operate as the spring force of coil springs 104*a* continue to transfer force from mounting bracket 19 (and therefore, excavator 12) to ram frame 139 via mounting base 102. Accordingly, a multiplicity of blows of ram 120 may be effected upon anvil 148 and pile 14 without need for readjustment of boom 16 of excavator 12, even though jump arrestor assembly 100 remains functionally interposed between reciprocating hammer 110 and mounting bracket 19. As the extension of the springs of shock absorbers 104 progresses, their downward force on frame 139 decreases.

Eventually, after a sufficient number of blows from ram 120 upon pile 14 via anvil 148, shock absorbers 104 reach their fully extended position as shown in FIG. 19*c*, such that any further blows from ram 120 may cause a gap to form between shock absorbers 104 and mounting bracket 19, thereby causing jump arrestor assembly 100 to become functionally disconnected from mounting bracket 19 and ram frame 139. At this point, the operator can articulate boom 16 to move mounting bracket 19 downwardly and recompress shock absorbers 104 to the configuration shown in FIG. 19*a*, at which point the cycle may begin again.

In one exemplary embodiment, a 12 inch travel may be provided between the fully compressed position of jump arrestor assembly 100 shown in FIG. 19*a* and a fully extended position shown in FIG. 19*c*. However, it is contemplated that any amount of travel may be provided as required or desired for a particular application. In one alternative application, a jump arrestor assembly 100 may be provided with a 24 inch total travel.

Figure 21:
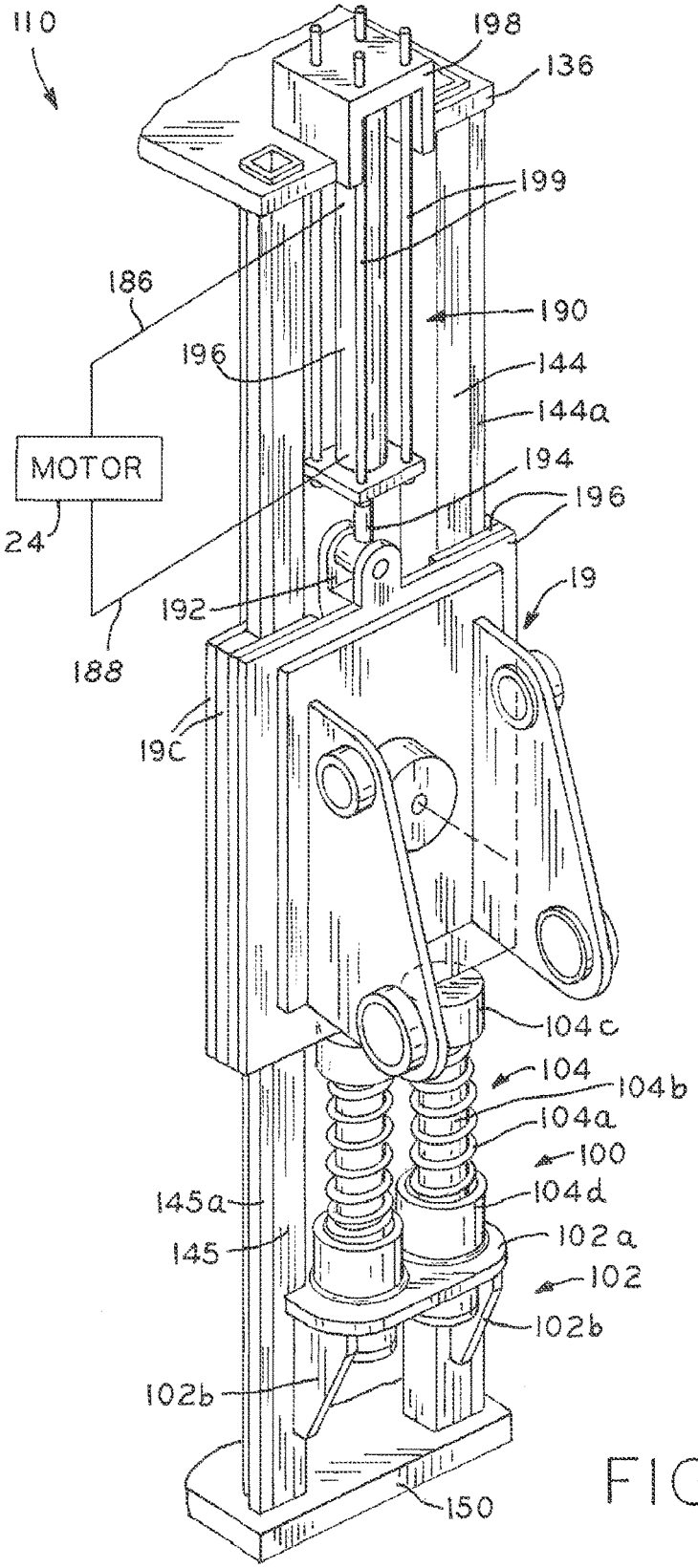
FIG. 21 is a perspective view of an alternative jump arrestor assembly, including an impact-assist cylinder.

Turning now to FIG. 21, hold-down cylinder 190 is illustrated as a further addition to jump arrestor assembly 100. Cylinder 190 is fluidly connected to motor 24 to capture or "scavenge" the elevated hydraulic energy passing through motor 24 during compression of accumulator 28 while lifting ram 20, and to convert this scavenged energy into a hold-down force on ram frame 39 which further inhibits frame jumping and promotes full energy delivery from ram 20 to pile 14.

Cylinder 190 is positioned between top plate 136 of frame 39 and mounting bracket 19 of excavator 12 (FIG. 1). In particular, the body 196 of cylinder 190 is fixd to mounting bracket 198, which is fixed (e.g., by welding) to top plate 136 and supported by support rods 199. The rod 194 of cylinder 190 is fixed to mounting bracket 19 via clevis 192. Thus, when mouting bracket 19 moves downwardly along frame members 144, 145, rod 194 extends outwardly from body 196 and vice versa.

Cylinder 190 is also functionally interposed between return fluid line 186 and supply fluid line 188 of motor 24. As hydraulic pressure builds to power motor 24, supply line 188 diverts some of the high-pressure hydraulic fluid to the "pull side" of cylinder 190 as shown. That is, hydraulic pressure applied to motor 24 also serves to urge rod 194 to retract into body 196. Return line 186 allows any pressure built on on the "push side" of cylinder to be relieved but does not actively urge rod 194 to extend from body 196.

During the lifting of ram 20 (described in detail above), the hydraulic pressure used to power motor 24 also applies hydraulic pressure to cylinder 190, which in turn pulls the upper portion of frame 39 downwardly toward the relatively stationary mounting bracket 19. As motor 24 lifts ram 20 through assisted stroke length $S_A$ (FIG. 10), the hydraulic pressure applied to cylinder 190 rises owing to the increased load on motor 24. Thus, at the moment of release of ram 20, a large hydraulic pressure is built up on cylinder 190, and is pulling frame 39 downwardly. The time for this pressure to disspate is longer than the time for ram 20 to fall through assisted stroke length $S_A$, such that the hold-down effect of cylinder 190 is active at the moment when ram 20 may be most likely to "jump" as described above. Thus, cylinder 190 provides a further inhibitor to frame jump in addition to jump arrestor assembly 100. In an exemplary embodiment, cylinder 190 may have an overall stroke length (i.e., the length difference between a fully retracted and fully extended position) about equal to the total effective travel of shock absorbers 104.

6. Resilient Accumulators

As noted above, the exemplary fluid-pressure accumulator 28 described in detail above may be replaced with a resilient element (e.g., a spring or set of springs) as shown in FIGS. 23-27 with respect to reciprocating hammers 210A, 210B and 210C having accumulators 228A, 228B and 228C respectively.

Except as otherwise noted herein, references to reciprocating hammer 210 and its constituent parts includes any of the three illustrated embodiments of hammer 210A, 210B and 210C, and can be used and configured in the same way as reciprocating hammers 10 and 110. Moreover, reciprocating hammers 210 are similar to reciprocating hammers 10 and 110 described above, and structures of hammers 210 are analogous to corresponding structures of hammers 10, 110 and denoted with a common reference number, except with 200 or 100 added thereto respectively. Except as otherwise set forth herein, the structures of hammers 210 are identical or substantially unchanged from their counterparts in hammers 10 and 110, and the features, functions and uses of hammers 10 and 110 also apply to hammers 210.

Figure 22:
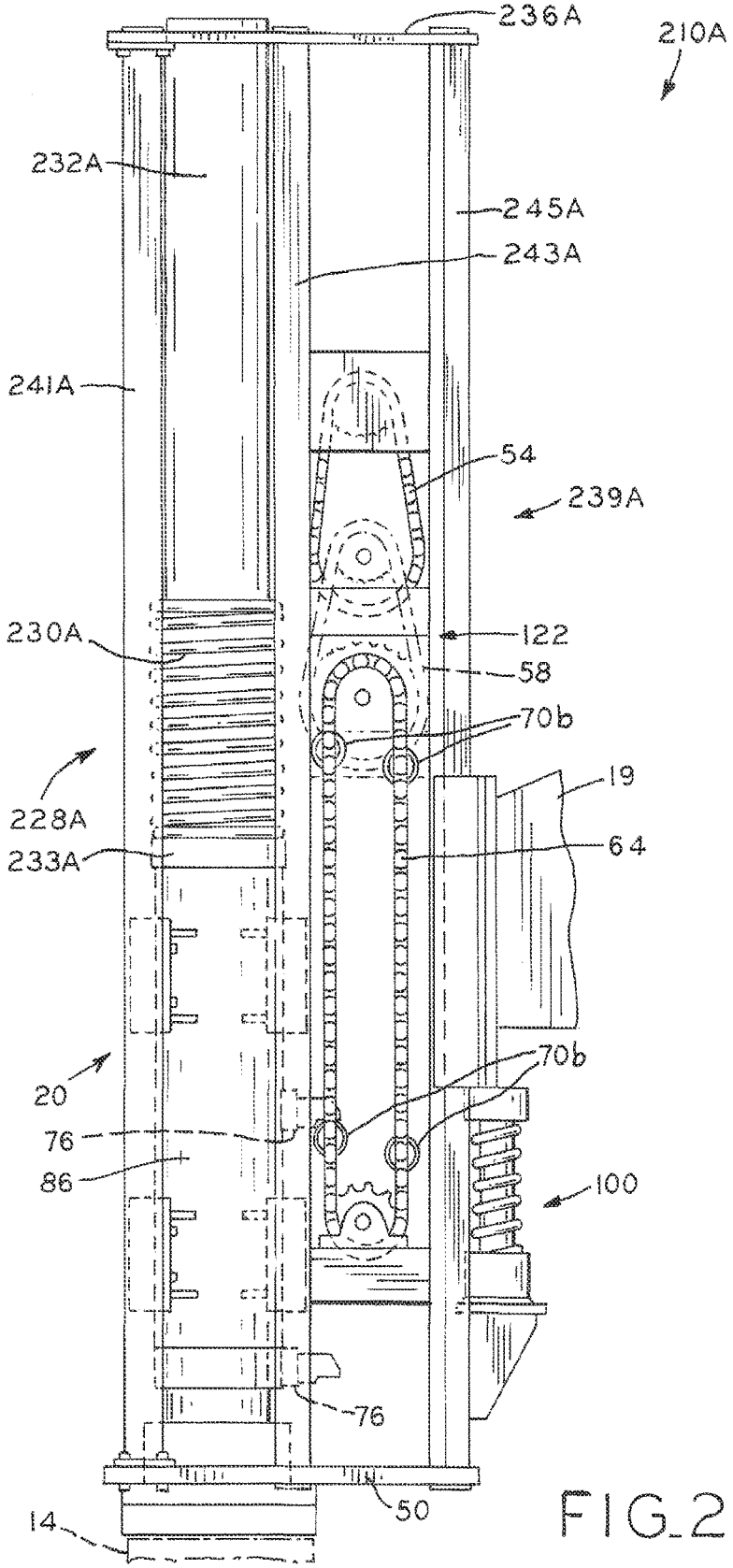
FIG. 22 is an elevation view of an alternative reciprocating hammer in which a spring and spring guide are used as a thrust accumulator.
Figure 23:
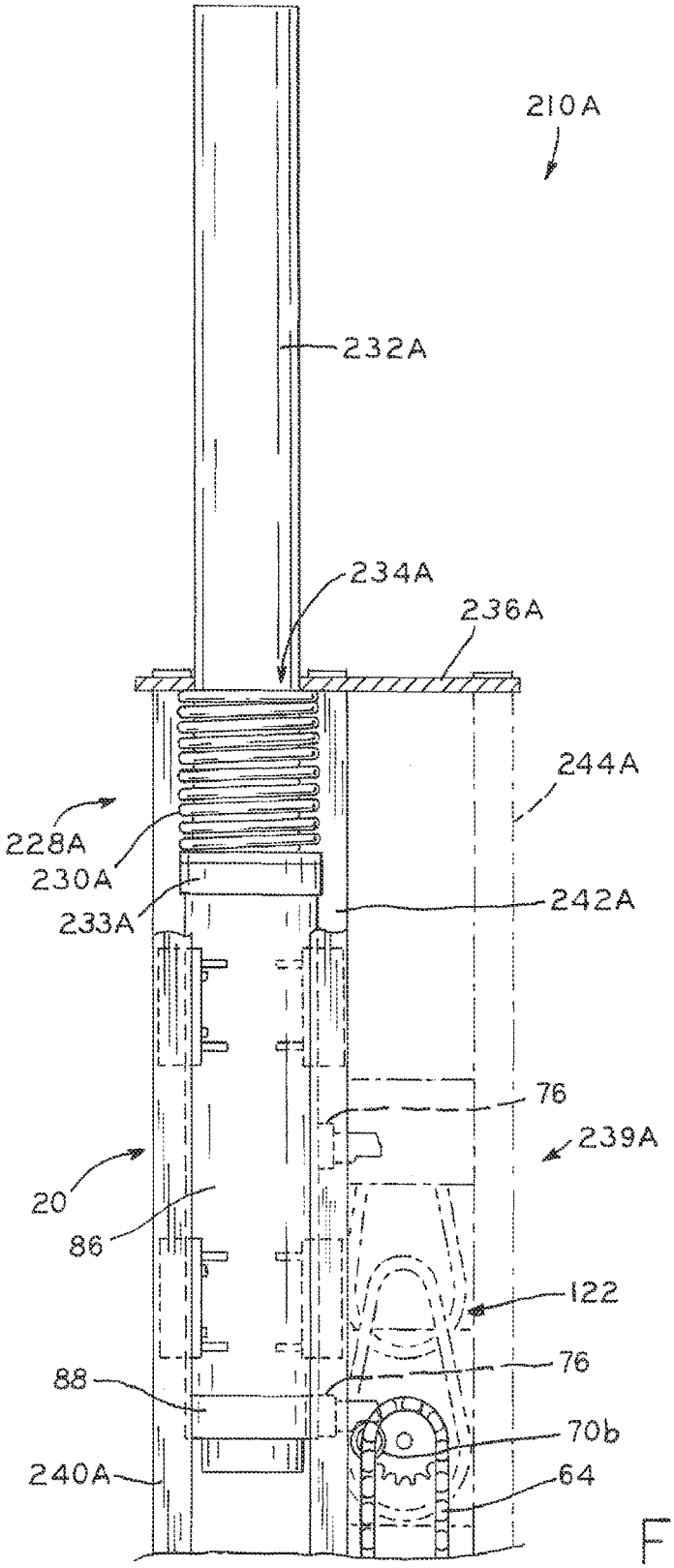
FIG. 23 is a partial elevation view of the spring and spring guide shown in FIG. 22, illustrating the thrust accumulator in a compressed configuration.

Turning to FIG. 22, a first embodiment of reciprocating hammer 210 is shown as hammer 210A including a single-spring accumulator 228A. Accumulator 228A includes spring 230A coiled around spring guide 232A, which rises upwardly from a modified, flanged top cap 233A of ram 20 and through aperture 234A in top plate 236A of frame 239A (FIG. 23). In the illustrated embodiment, spring 230A rests upon top cap 233A under its own weight and may be fixed thereto (e.g., by adhesive, welding or fasteners), though it is contemplated that spring 230A may alternatively be fixed to the lower surface of top plate 236A.

The other components of hammer 210 are substantially identical to those of hammer 110 described above, including drive assembly 122, ram 20, jump arrestor 100 and frame 239, except that the various vertical frame members 240A, 241A, 242A, 243A, 244A and 245A have been lengthened to accommodate the increased vertical stroke of ram 20 owing to the provision of a pair of lifters 76 arranged to engaged a corresponding pair of roller assemblies 70*b* as described above.

As ram 20 is lifted into its fully raised position shown in FIG. 23, spring 230A comes into the contact with the lower surface of top plate 236A and resiliently compresses into the illustrated configuration. In the illustrated embodiment, the top position is corresponds with the point of disengagement between the second or lower roller assembly 70*b* and the second or lower lifter 76, as illustrated in FIG. 23. Thus, the first or upper lifter 76 has previously disengaged from the first or upper roller assembly 70*b* and is elevated above lifter chain 64.

The resilient compression of spring 230A stores energy which is discharged to ram 20 after the lower lifter 76 and roller assembly 70*b* disengage, similar to the discharge of energy from thruster 28 as described above. This accelerates ram 20 downwardly to increase the energy delivered by ram 20 to pile 14, as also described in detail above with respect to accumulator 28. The spring rate and length of compression of spring 230A may be chosen to deliver an appropriate amount of acceleration and additional energy to ram 20 as required or desired for a particular application. In an exemplary embodiment in which ram 20 weighs between 2000 and 3000 lbs and has a overall stroke length $S_{AG}$ between 4 and 6 feet, for example, spring 230A may have a rate between 100 and 1500 lbf/inch and a total compression length between its uncompressed state (FIG. 22) and its fully compressed state (FIG. 23) of between 5 inches and 12 inches, for a total energy addition to ram 20 of between 2,000 ft-lb and 30,000 ft-lb. Of course, it is contemplated that spring 230A and its associated components may be scaled up or down for other applications. In most embodiments, the total stroke of spring 230 will be substantially less than the overall stroke length $S_{AG}$ such that reciprocating hammer 210A retains a "two-stage" two-stage stroke length $S_{AG}$ through assisted stroke length $S_A$ and freefall stroke length $S_G$ (FIG. 10).

Figure 24:
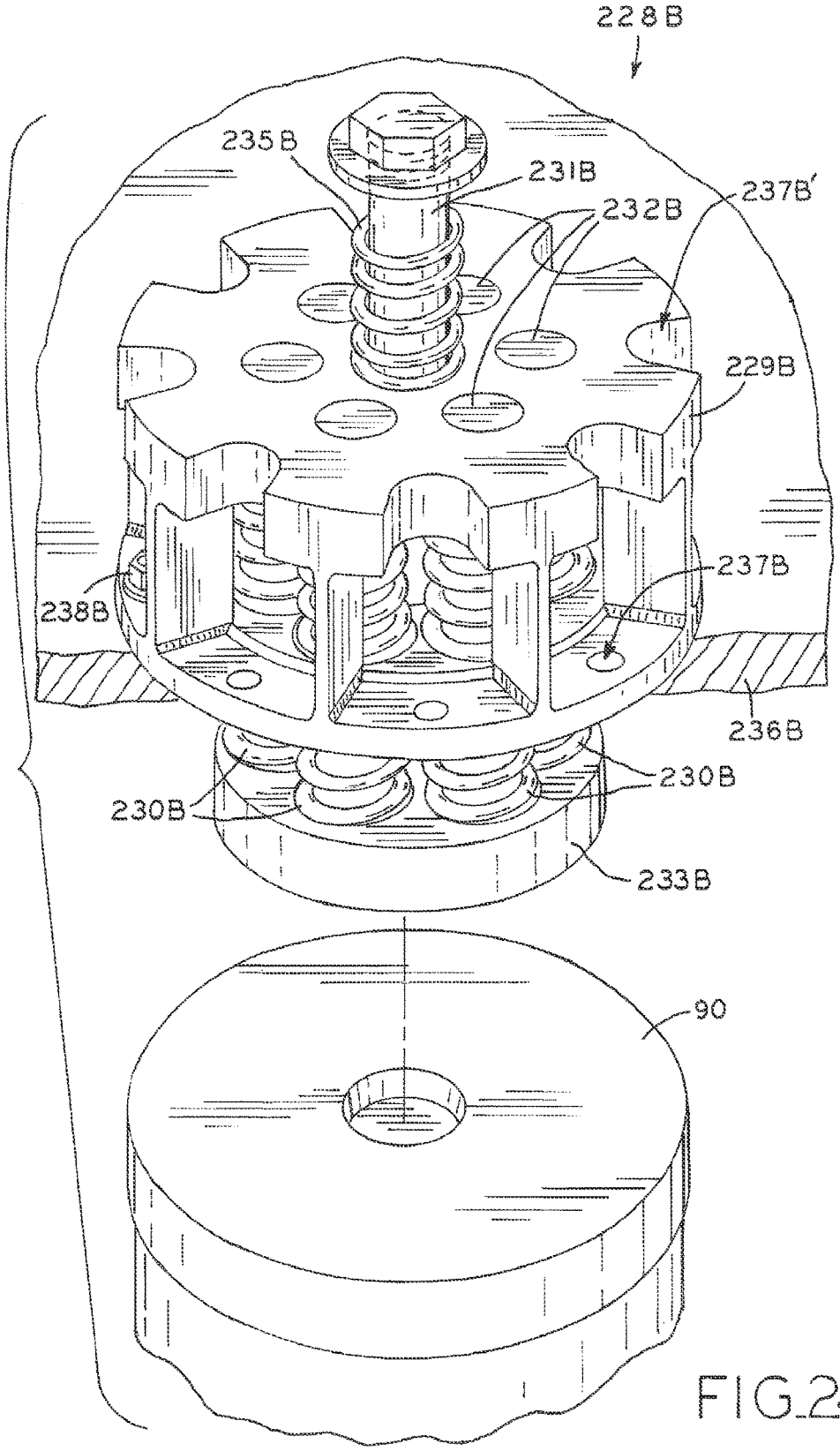
FIG. 24 is a perspective view of another alternative thrust accumulator using springs and spring guides arranged in a housing.

Turning now to FIG. 24, a multi-spring accumulator 228B is illustrated. Accumulator 228B includes spring housing 229B with apertures 237B sized to receive fastners 238B to fasten accumulator 228B to top plate 236B of frame 239B (not shown, but similar or identical to other frames 39, 139 and 239 described herein). Cutouts 237B' are included in a top portion of housing 229B to provide a tool path for installing or removing fasteners 238B. Moreover, housing 229B may be installed in the same manner, and at the same location, as accumulator 28 or 128 described in detail above and can therefore be used as a "drop-in" replacement for accumulators 28 or 128 with no further modifications of the other parts of hammers 10 or 110.

Figure 25:
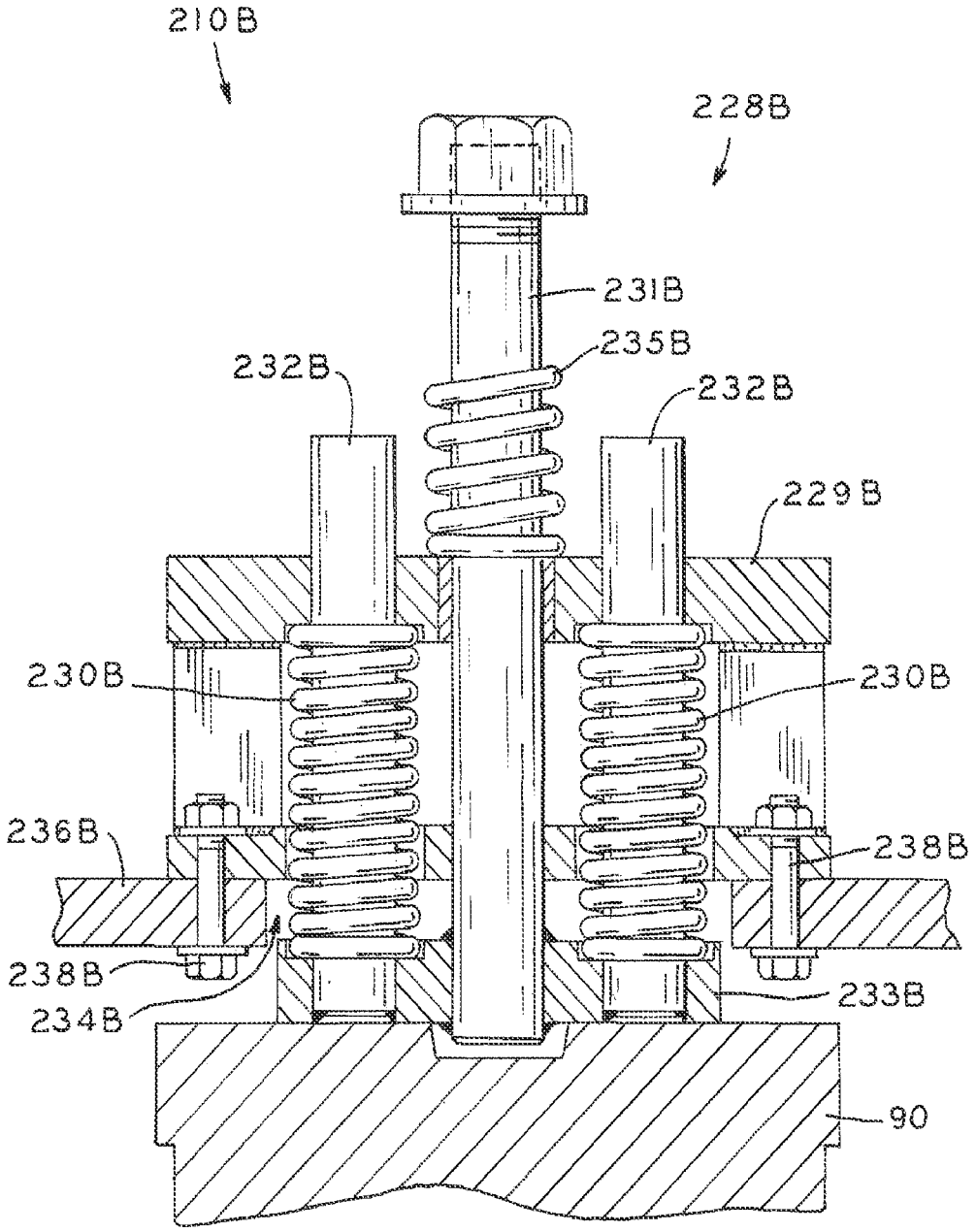
FIG. 25 is a partial elevation view of an alternative reciprocating hammer using the alternative thrust accumulator of FIG. 24, in which the thrust accumulator in a compressed configuration.

FIG. 25 illustrates multi-spring accumulator 228B in its compressed configuration, with upper cap 90 of ram 20 (not shown) bearing against pusher plate 233B. Springs 230B are captured between pusher plate 233B and the top portion of housing 229B, and spring guides 232B are allowed to extend upwardly out of frame 239B as illustrated. Aperture 234B is sized for clearance of pusher plate 233B therethrough, which simiplifies installation of accumulator 228B and allows pusher plate 233B to enter aperture 234B for maximum compression of springs 230B. When ram 20 is released as described above, springs 230B extend to accelerate ram 20 through its assisted stroke length $S_A$.

A central guide rod 231B may also be provided to maintain alignment of pusher plate 233B with spring housing 229B during operation of multi-spring accumulator 228B. In addition, catch spring 235B may be provided along the lower portion of guide rod 231B above housing 229B to soften the final downward thrust of pusher plate 233B when springs 230B have discharged their stored energy to ram 20.

In the above-described exemplary embodiment in which ram 20 weighs between 2000 and 3000 lbs and has a overall stroke length $S_{AG}$ between 4 and 6 feet, for example, six springs 230B may each be provided with a rate between 50 and 250 lbf/inch and a total compression length between their uncompressed state (FIG. 24) and their fully compressed state (FIG. 25) of between 6 inches and 12 inches, for a total energy addition to ram 20 of between 2000 ft-lb and 30,000 ft-lb. Of course, it is contemplated that the number of springs 232B may be greater or fewer and may have different rates and compression lengths as needed, and that the overall system of multi-spring accumulator 228B may be scaled up or down for other applications.

Figure 26:
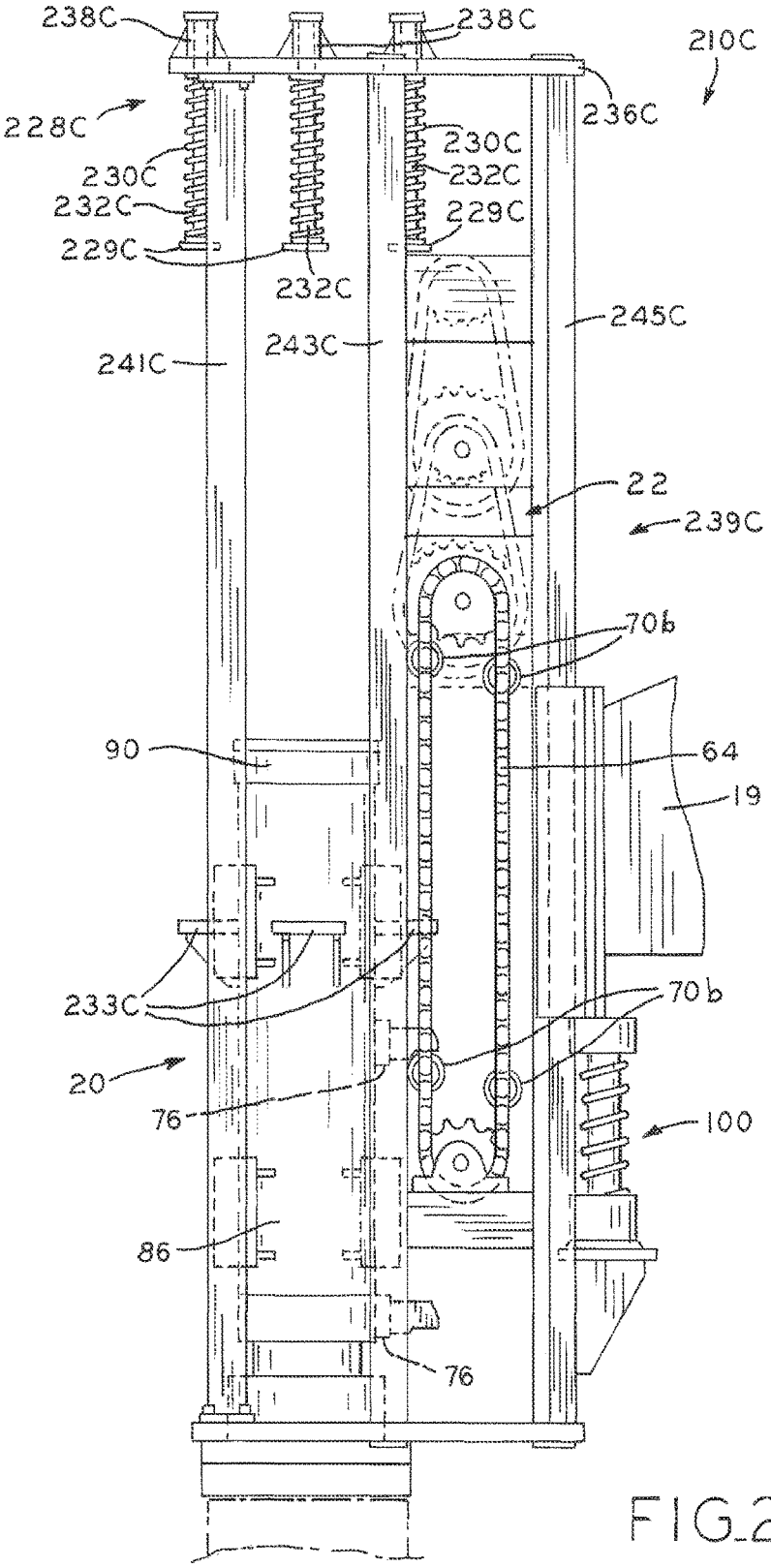
FIG. 26 is an elevation view of yet another alternative reciprocating hammer in which annularly arranged springs and spring guides are used as a thrust accumulator.

A third embodiment of a spring-biased accumulator is shown in FIG. 26 as multi-spring accumulator 228C, which includes a plurality of annularly arranged springs 230C connected to top plate 236C of ram frame 239C as illustrated. In this embodiment, a portion of ram 20 (e.g., upper cap 90 and a portion of shell 86) may pass through aperture 234C formed in top plate 236C (FIG. 27), while springs 230C remain captured between a lower surface of top plate 236C and spring flange 233C attached to a lower portion of ram 20 (e.g., to shell 86 as illustrated). This arrangement accommodates a large vertical stroke of ram 20 and provides assisted stroke length $S_A$, all while minimizing the overall height of reciprocating hammer 210C.

Figure 27:
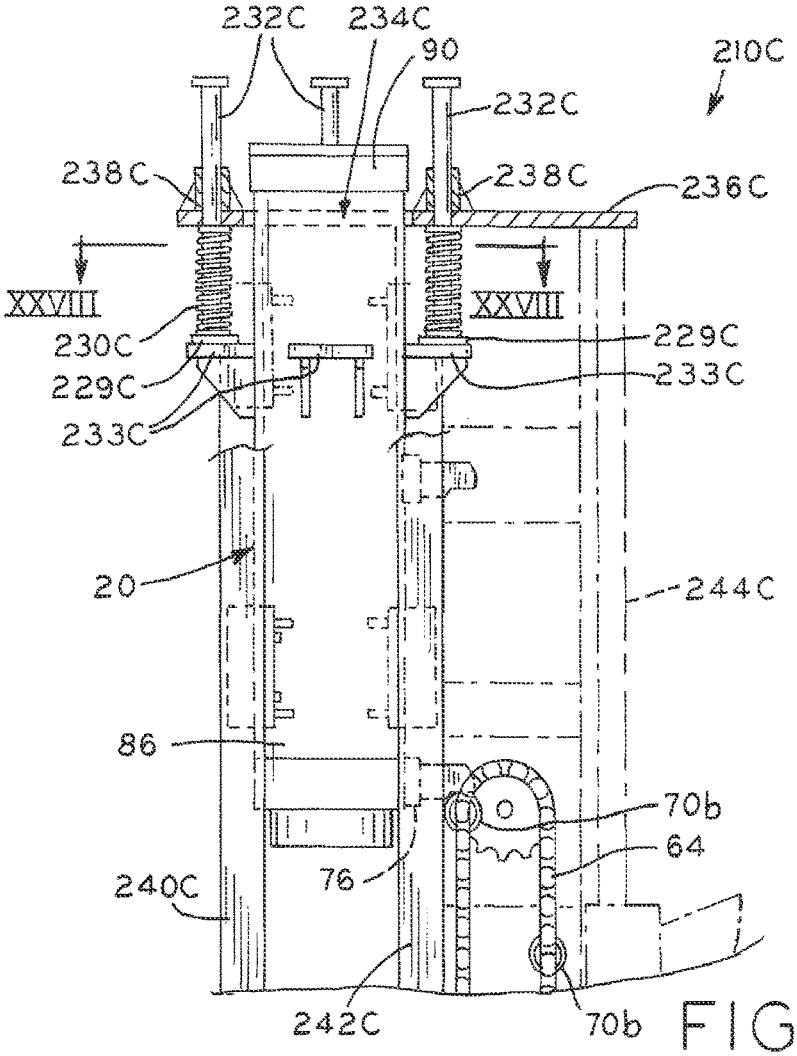
FIG. 27 is a partial elevation view of the spring and spring guide shown in FIG. 26, illustrating the thrust accumulator in a compressed configuration.

Spring guides 232C pass through respective apertures in top plate 236C, and are received by connecting collars 238C mounted to the top surface of top plate 236C as shown in FIG. 26. Springs 230C are received on spring guides 232C and bear at their upper axial ends on the lower surface of top plate 236C, and at their lower axial ends on respective spring retention plates 229C fixed to respective guides 232C. As ram 20 reaches the top of its stroke as shown in FIG. 27, respective spring flanges 233C fixed thereto (e.g., by welding) bear against retention plates 229C and compress springs 230C, storing energy for discharge to ram 20 through assisted stroke length $S_A$ as described above with respect to the other accumulators 228.

Figure 28:
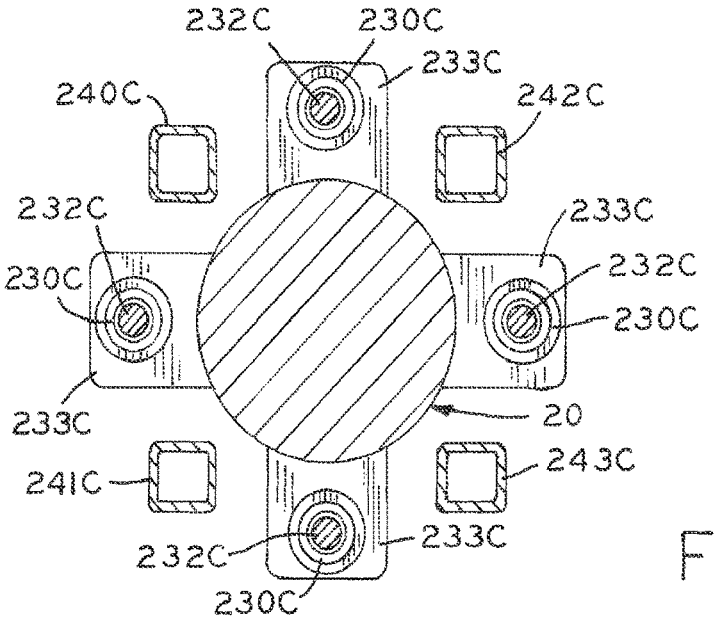
FIG. 28 is a plan, cross-section view of the springs, guides and spring plate used in the thrust accumulator of FIG. 26, taken along the line XXVIII-XXVIII of FIG. 27.

As illustrated in FIG. 28, the illustrated embodiment includes four springs 230C with their corresponding components, and spring flanges 233C are shaped, sized and configured to pass freely between the respective spaces between vertical frame members 240C, 241C, 242C and 243C. However, any number of springs 230C may be provided and annularly arranged around ram 20 as required or desired for a particular application, and are preferably evenly annularly spaced around one another to avoid inducing an off-axis torque on ram 20 during acceleration through assisted stroke length $S_A$. If desired, frame members 240C, 241C, 242C and 243C can be moved further from ram 20 to provide additional room for springs 230C.

In the above-described exemplary embodiment in which ram 20 weighs between 2000 and 3000 lbs and has a overall stroke length $S_{AG}$ between 4 and 6 feet, for example, four springs 230C may be provided with a rate between 100 and 400 lbf/inch and a total compression length between their uncompressed state (FIG. 26) and their fully compressed state (FIG. 27) of between 5 inches and 12 inches, for a total energy addition to ram 20 of between 2,000 ft-lb and 30,000 ft-lb. Of course, it is contemplated that fewer or more springs 230C may be provided, and may have different rates and compression lengths as needed, and that the overall system of multi-spring accumulator 228C may be scaled up or down for other applications.

While this invention has been described as having an exemplary design, the present process can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reciprocating hammer comprising:

a ram cyclically movable from a raised position to an impact position along a two-stage stroke length, said two-stage stroke length comprising an assisted stroke length and a freefall stroke length, said assisted stroke length extending from the raised position to an intermediate position and said freefall stroke length extending from the intermediate position to the impact position;

a drive mechanism selectively functionally coupled to the ram and operable to lift the ram from the impact position through the two-stage stroke length and to the raised position, and then to functionally decouple from the ram to allow the ram to fall from the raised position to the impact position; and a thruster selectively functionally coupled to said ram and compressible by said ram as said ram advances from the intermediate position to the raised position, said thruster receiving stored energy from said drive mechanism as said thruster compresses, said thruster discharging the stored energy to the ram as the ram falls through the assisted stroke length whereby said thruster releases the stored energy to said ram in cooperation with gravity to initially accelerate said ram through said assisted stroke length, said thruster functionally decoupled from said ram at the intermediate position whereby said ram further accelerates through said freefall stroke length under the force of gravity alone.

2. The reciprocating hammer of claim 1, wherein said thruster comprises:

a fluid chamber;

a piston positioned to hermetically seal said fluid chamber, said piston axially moveable within said fluid chamber to define a variable fluid volume available in said fluid chamber and correspondingly variable fluid pressure in said fluid chamber; and a piston rod fixed to said piston and having a distal end extending downwardly away from said fluid chamber, said piston rod able to travel along a thrust stroke through which said distal end is biased downwardly by a variable thrust force inversely correlated to said variable fluid volume and directly correlated to said variable fluid pressure, said distal end of said piston rod engaged by said ram through said assisted stroke length, such that said piston rod is positioned to transmit the variable thrust force to said ram throughout said thrust stroke as said ram advances from the raised position to the intermediate position.

3. The reciprocating hammer of claim 2, wherein said thruster does not include any valves, ports or other apertures designed to admit or exhaust working fluid as said piston and said piston rod cycle between respectively extended and compressed positions of said thrust stroke.

4. The reciprocating hammer of claim 2, wherein said thruster comprises a predetermined quantity of compressed gas and oil captured within said fluid chamber, whereby said reciprocating hammer excludes fluid control apparatuses in connection with said thruster and said fluid chamber remains substantially hermetically sealed during operation of the reciprocating hammer.

5. The reciprocating hammer of claim 4, wherein said gas consists essentially of nitrogen.

6. The reciprocating hammer of claim 1, further comprising a support frame, said ram moveable along said two-stage stroke length within said support frame, said thruster comprising at least one spring interposed between said ram and said support frame.

7. The reciprocating hammer of claim 6, further comprising a spring guide disposed within the at least one spring, said spring guide extending upwardly through an upper portion of said support frame when said at least one spring is compressed by said ram.

8. The reciprocating hammer of claim 7, wherein the at least one spring comprises a single spring disposed on an upper surface of said ram, said spring guide extending upwardly from said upper surface through an aperture in a top plate of said support frame.

9. The reciprocating hammer of claim 6, wherein said at least one spring comprises a plurality of springs annularly arranged about said ram and disposed between a plate of said support frame and a retention plate fixed to said ram, said springs positioned to compress between said plate of said support frame and said retention plate when said ram is moving through said assisted stroke length.

10. The reciprocating hammer of claim 1, further comprising a support frame, said ram moveable along said two-stage stroke length within said support frame, wherein said thruster comprises:

a spring housing mounted to said support frame;

a pusher plate slideably fixed to said support frame and moveable along an axial direction of the ram, said pusher plate positioned and configured to be advanced upwardly by said ram as said ram moves from the intermediate position to the raised position;

at least one spring disposed between said spring housing and said pusher plate and operable to urge said pusher plate downwardly.

11. The reciprocating hammer of claim 10, wherein said at least one spring comprises a plurality of springs annularly arrange about a central guide rod, said central guide rod fixed to said pusher plate and axially moveable with respect to said spring housing.

12. The reciprocating hammer of claim 11, wherein said thruster further comprises a catch spring operably disposed between said central guide rod and said spring housing.

13. The reciprocating hammer of claim 1, further comprising:

a support frame, said ram moveable along said two-stage stroke length within said support frame;

a mounting bracket slidably attached to said support frame; and a jump arrestor assembly comprising at least one shock absorber functionally interposed between said support frame and said mounting bracket.

14. The reciprocating hammer of claim 13, wherein:

said at least one shock absorber comprises a biasing element, and said jump arrestor assembly further comprises a mounting base fixed to said support frame, said biasing element bearing on said mounting base at one end and said mounting bracket at an opposing end, said mounting bracket positioned above said mounting base such that upward movement of said support frame is resisted by a biasing force of said biasing element when said mounting bracket is held in a stationary position.

15. The reciprocating hammer of claim 13, wherein said drive mechanism further comprises a hydraulic motor which provides motive force to lift said ram from the impact position to the raised position, said jump arrestor assembly comprises:

a hold-down cylinder fluidly connected to said motor to capture hydraulic pressure passing through said motor during compression of said thruster while lifting said ram through said assisted stroke length to create a captured hydraulic pressure, said hold-down cylinder connected to said support frame such that said captured hydraulic pressure is converted into a hold-down force on said support frame.

16. The reciprocating hammer of claim 15, wherein:

said hold-down cylinder comprises a cylinder body and a rod slideably connected to said cylinder body, said hold-down cylinder positioned between a top plate of said support frame and said mounting bracket, and said hold-down cylinder fluidly connected to said motor such that said captured hydraulic pressure urges said rod to retract into said cylinder body.

17. The reciprocating hammer of claim 1, wherein said ram comprises a shell enclosing an internal cavity, said internal cavity containing a filler fixed within said internal cavity whereby said ram comprises a solid construct without moveable internal mass.

18. The reciprocating hammer of claim 1, wherein said drive mechanism comprises:

a lifter fixed to said ram;

a lifter drive chain; and a lift device selectively coupled to said lifter and operable to lift said ram from the impact position to the raised position.

19. The reciprocating hammer of claim 18, wherein said lift device comprises a roller assembly fixed to said lifter drive chain, said roller assembly comprising a roller core fixed to at least one link of said lifter drive chain and a roller sleeve rotatably received on said roller core, said roller assembly upwardly moveable along an upward portion of a drive pathway of said lifter drive chain, and said roller assembly selectively engageable with said lifter along the upward portion of said drive pathway such that said lifter drive chain lifts said ram from the impact position through the intermediate position and to the raised position.

20. The reciprocating hammer of claim 19, wherein said roller assembly comprises a first, upper roller assembly and said lifter comprises a first, upper lifter, said drive mechanism further comprising:

a second lifter attached to said ram above said first lifter by a first separation distance; a second roller assembly spaced apart from said first roller assembly along said lifter drive chain by a second separation distance equal to or slightly larger than said first separation distance, such that said second, lower roller assembly comes into engagement or near-engagement with the second, lower lifter as said ram is lifted toward the raised position, and such that said second, lower lifter remains engaged with said second, lower roller assembly after said first, upper lifter has disengaged from said first, upper roller assembly as said ram advances toward the raised position.

21. The reciprocating hammer of claim 19, wherein said drive mechanism further comprises a motor driving a primary drive shaft, said primary drive shaft providing a motive force for said lifter drive chain.

22. The reciprocating hammer of claim 21, wherein said support frame comprises:

a ram frame including a bottom plate, a top plate, and a first plurality of vertical frame members connecting said bottom plate to said top plate and defining said two-stage stroke length, said thruster operably disposed between said top plate of said ram frame and said ram;

a drive assembly frame adjacent said ram frame, said drive assembly frame including a second plurality of vertical frame members supporting said motor, said primary drive shaft and said lifter drive chain; and an anvil adjacent to said bottom plate of said ram frame, said anvil positioned to receive an impact from said ram when said ram advances along said two-stage stroke length to the impact position.

23. The reciprocating hammer of claim 22, further comprising a lower rotatable shaft defining a lower end of said drive pathway of said lifter drive chain, said lower rotatable shaft rotatably supported by said drive assembly frame.

24. The reciprocating hammer of claim 18, wherein said drive mechanism comprises a rotatable cam shaft fixed to at least one cam, said at least one cam comprising a cam lobe defining an upward sweep along a portion of a rotational movement arc of said at least one cam, said at least one cam selectively engageable with said lifter at an upper portion of a drive pathway of said lifter drive chain, such that said at least one cam lobe lifts said ram from said intermediate position to said raised position via said lifter.

25. The reciprocating hammer of claim 1, wherein said thruster defines a thrust stroke having an axial extent of about twelve inches.

* * * * *